US009672694B2

(12) United States Patent
Lowell et al.

(10) Patent No.: US 9,672,694 B2
(45) Date of Patent: Jun. 6, 2017

(54) SHARED PROGRESSIVE WITH CERTIFICATES GAMING SYSTEM AND METHOD

(71) Applicant: Bally Gaming, Inc., Las Vegas, NV (US)

(72) Inventors: Mark Lowell, Reno, NV (US); Loren T. Nelson, Reno, NV (US); Will Jones, Boulder, CO (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 13/854,793

(22) Filed: Apr. 1, 2013

(65) Prior Publication Data

US 2014/0024444 A1 Jan. 23, 2014

Related U.S. Application Data

(60) Provisional application No. 61/672,887, filed on Jul. 18, 2012.

(51) Int. Cl.
*G07F 17/00* (2006.01)
*G07F 17/32* (2006.01)

(52) U.S. Cl.
CPC ..... *G07F 17/3258* (2013.01); *G07F 17/3267* (2013.01)

(58) Field of Classification Search
CPC ..... G07F 17/32; G07F 17/3258
USPC ..... 463/27
See application file for complete search history.

*Primary Examiner* — Reginald Renwick
(74) *Attorney, Agent, or Firm* — Philip J. Anderson; Marvin A. Hein

(57) ABSTRACT

Disclosed is a progressive system for paying out a primary progressive prize and a secondary progressive prize. The system includes a progressive controller, a plurality of game devices each configured to execute a game of chance and a network interconnecting the progressive controller and the game devices. A funding module is executable by the progressive controller to maintain primary and secondary award pools. In accordance with one or more embodiments, the game devices may award shares of the secondary progressive pool to players. When the primary progressive is triggered, share holders may redeem their shares for a value determined by the system. In some embodiments, winners of shares may monitor the value of their pending certificates through various outlets such as social media sites.

5 Claims, 20 Drawing Sheets

1310

| Description | Reset | Contrib% | Max Value | Avg Hit Value | Avg Wager to Hit | EGM Cour | Avg Play | Odds to W | Average Frequency of Hit days | hours | minutes |
|---|---|---|---|---|---|---|---|---|---|---|---|
| Primary Jackpot | $100,000.00 | 0.5000% | NA | $850,000.00 | $150,000,000.00 | 500 | $5,000.00 | | 60 | 1440 | 0 |
| Certificate Pool | $0.00 | 0.7500% | NA | $1,125,000.00 | NA | NA | NA | | NA | | |
| Certificate Mystery | $50.00 | 0.5000% | $150.00 | $100.00 | $10,000.00 | | | | 0 | 0 | 5.76 |
| | | | | | | | | | | | |
| Primary Jackpot Reset Cost | 0.0667% | | | | | | | | | | |
| Cert. Mystery Reset Cost | 0.5000% | | | | | | | | | | |
| Avg Cert. Count | 15000 | | | | | | | | | | |
| Avg Cert. Value | $75.00 | | | | | | | | | | |
| | | | | | | | | | | | |
| Total Progressive Cost | 2.3167% | | | | | | | | | | |

1315

| Description | Reset | Contrib% | Max Valu | Avg Hit Value | Avg Wager to Hi | EGM Co | Avg Play | Average Frequency days | hours | min |
|---|---|---|---|---|---|---|---|---|---|---|
| Primary Jackpot | $100,000.00 | 0.7500% | NA | $850,000.00 | $100,000,000.00 | 500 | $5,000.00 | 40 | 960 | 0 |
| Distribution Jackpot | $0.00 | 0.2500% | NA | $250,000.00 | NA | NA | NA | NA | | |
| Certificate Mystery | $50.00 | 0.5000% | $150.00 | $100.00 | $10,000.00 | | | 0 | 0 | 5.76 |
| | | | | | | | | | | |
| Primary Jackpot Reset Cost | 0.1000% | | | | | | | | | |
| Cert. Mystery Reset Cost Pct | 0.5000% | | | | | | | | | |
| Theo Cert. Mystery Reset Cost | $500,000.00 | | | | | | | | | |
| Step Down Percent | 0.99000 | | | | | | | | | |
| Avg Cert. Count | 460 | | | | | | | | | |
| Actual Mystery Reset Cost | $23,000.00 | | | | | | | | | |
| Avg Contrib Divert | $476,990.50 | | | | | | | | | |
| Avg Reset Divert | $477,000.00 | | | | | | | | | |
| Total Distributed Jackpot | $1,203,990.50 | | | | | | | | | |
| Avg Certificate Value | $2,617.37 | | | | | | | | | |
| | | | | | | | | | | |
| Total Progressive Cost | 2.1000% | $2,100,000.00 | | | | | | | | |
| | 2.1000% | $2,099,990.50 | | | | | | | | |
| | 0.0000% | $9.50 | | | | | | | | |

1325

1320

FIG. 13

SHARED PROGRESSIVE WITH CERTIFICATES GAMING SYSTEM AND METHOD

RELATED APPLICATIONS

This application is a non-provisional application of U.S. Provisional Application 61/672,887 filed on Jul. 18, 2012, hereby incorporated by reference in its entirety for all purposes.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

1. Field of the Invention

This invention pertains generally to progressive systems for gaming. More particularly, this invention relates to a shared progressive gaming system and method which allows a plurality of players to share a progressive prize.

2. The Prior Art

Progressive systems for gaming environments such as casinos are known. A typical progressive system arrangement includes a plurality of gaming devices, such as slot machines, video poker machines, video keno machines, video lottery machines, each linked for communication with a central progressive controller. A wager is made to play the game associated with the gaming devices. For each wager made at the gaming devices, a portion is used to fund a progressive prize which is maintained and accumulated by the progressive controller. The progressive prize is then awarded to a player upon the occurrence of a triggering win event, either determined pursuant to play on the gaming device or by some other criteria, such as according to a random determination by the progressive controller. Since the triggering win event for awarding the progressive prize occurs infrequently, the progressive prize generally accumulates to a large sum. As a result, players are attracted to playing the gaming devices in order to win the large progressive prize, thereby increasing game play and therefore overall revenue for the casino operator.

Efforts to improve this general scheme for paying a progressive prize have been attempted to further increase player interest. An example improvement arrangement is disclosed in U.S. Pat. No. 5,564,700 to Celona. In the Celona progressive method, a progressive jackpot is paid proportionally to eligible players at each of the linked gaming machines. The eligibility of players to share in the progressive jackpot may be conditioned upon "playing a maximum bet" within a "predetermined time interval before the progressive jackpot-winning outcome occurs." Payment of the progressive jackpot may be divided equally among all eligible players, or may be paid proportionally (e.g., the player at the machine that generated the progressive jackpot-winning outcome may receive a greater proportion (such as half) of the jackpot, or the proportion of the jackpot paid to each of the players may be adjusted in accordance with the contribution of each machine to the progressive jackpot sum).

While the payout method of Celona may foster increased participation and play form players, there are several drawbacks. First, the motivation for winning a large progressive jackpot is diminished, even where as in Celona "the player at the machine that generated the progressive jackpot-winning outcome may receive a greater proportion." This diminished motivation arises from the fact that the player perceives that he or she will have to "share" the displayed or advertised jackpot with other players. Players prefer playing for a large life-changing jackpot, and the sharing of the jackpot, even where the player receives a greater proportion, reduces the overall player interest.

Additionally, the incentive for remaining eligible to share in the jackpot is inadequate in the Celona implementation. For example, one way to determine eligibility is for the central controller to determine the interval between the time of play initiation on the gaming device and the time of the jackpot-winning outcome; if the time interval is less than the predetermined interval for jackpot eligibility, then the player qualifies to share in the jackpot. However, Celona carries out this calculation after the jackpot-winning outcome has already occurred. There are not indicators or cues provided to the player to encourage the player to remain eligible prior to the jackpot-winning outcome. Absent such indicators and cues, players are less informed and are less likely to satisfy the requirement of remaining eligible. This problem results in decreased play and lost revenues for the operator.

Accordingly, there remains a need for further increased player participation in progressive payout arrangements. The present invention satisfies these needs, as well as others, and generally overcomes the deficiencies found in the background art.

BRIEF DESCRIPTION OF THE INVENTION

The present invention is a system and method for providing an enhanced shared progressive system and method, suitable for use in gaming establishments such as casinos. The progressive system may be used in a wide area environment and/or a local area environment.

In general, the progressive system comprises at least one progressive controller coupled for communication with one or more gaming devices (or player terminals) via a networking connection. A funding module operating in the progressive controller maintains a primary progressive prize and a secondary progressive prize, the progressive prizes displayed normally by the progressive controller using a progressive display meter or other display means. In operation, the funding module funds the progressive prizes which are awarded as described in greater detail further below. Various funding arrangements are suitable for use in funding the prizes, including using a percentage of wagers placed on the gaming devices, or using a percentage of the pay table awards for paying prizes on the gaming devices, for example.

An enrolment module operating in the gaming device carries out several operations as described in more detail further below. In general, the enrolment module monitors game events on the gaming device and further communicates with the funding module to indicate the "active" or "inactive" status of the gaming machine on which a player may be playing, based on the determined game events. According to one aspect of the present invention, an "active" status on a gaming machine allows a player to be eligible for a secondary progressive prize distribution event, in a manner associated with the gaming machine (i.e., candle lights up for traditional handpays that exceed the automated payout thresholds set by each casino or operator, credits are downloaded to the game machine, credits are associated with the player's player account if the player is using a tracking card, etc.). Like the secondary progressive distribution event, the primary progressive win event may be carried in any manner associated with the win event on a gaming machine, including but not limited to bill pays, coin pays, handpays, adding play credits to the gaming machine's credit meter, adding credit amounts to a player's account if the player is using a player tracking card, issuing a redemption voucher that may or may not be associated with a specific player from the gaming machine having the winning event, etc. Various strategies may be used to determine the status of the player to encourage play on the gaming device, such as based on the average play over a period of time, or based on a requirement that the player perform some action within a period of time from the end of the previous game, for example.

The enrolment module is further coupled for communication with a status indicator. The status indicator may comprise various forms such as mechanical indicators or dials and/or electronic display indicators (e.g., video display, LED, LCD), or may comprise a portion of the base game display. The enrolment module displays the status of player (i.e., "active" or "inactive") through the status indicator. If the player's status is "active," the status indicator may further indicate how long the player's status will remain "active" before becoming "inactive" (e.g., a countdown indicator or dial). Other text messages may further be displayed to the player pursuant to this arrangement such as warnings, for example.

In operation, the system awards the primary and secondary progressive prizes pursuant to game events occurring on the gaming devices. In particular, the funding module monitors the communication network for specific progressive award triggering events which when triggered by a player, entitling the player to the primary progressive prize. Additionally, players who have an "active" status at the time of the progressive award triggering event are entitled to share in the secondary progressive prize. The share of the secondary prize may be distributed to players using various strategies including an equal share, or a proportional share based on one or more criteria (e.g., amount bet, average bet, player tracking points).

According to the present invention, players seeking large progressive wins are drawn to the system of the present invention because a large primary progressive prize may be won without sharing with other players; and at the same time players seeking to benefit from regular or active play are also drawn to the system because one or more shared secondary progressive prizes may be dispensed to the "active" player even if another player has won the large primary prize. Additionally, the enrolment module and status indicator provides a visible means for encouraging the player to remain active to qualify for the shared secondary prize. Under this arrangement, the present invention overcomes many of the disadvantages associated with the prior art.

According to another embodiment of the invention, the system further provides a prize expiration and reissue module executed by the central progressive controller or other central server device. According to this embodiment, the player may be awarded one or more prizes, which require redemption. Such prizes may be in the form of points, coupons, game pieces, for example and may require the player to accumulate or collect a certain amount or arrangement of points, coupons, game pieces, etc. The prizes may be awarded to a player using a variety of means, such as via a printed ticket or stored electronically using an account server, for example. In some cases, a player may not redeem his or her prize. In other cases, the player may not accumulate sufficient points, coupons, credits, etc. to enable the player to qualify for a prize, in which case, the points, coupons, credits, etc. may expire after a lapse period. Various other events may cause the prizes, points, etc. to expire. The prize expiration and reissue module of the present invention provides a means for tracking these prizes to determine expiration, and upon certain conditions reissuance of the expired prizes. According to one embodiment, the expired prizes are maintained and accumulated by the prize expiration and reissue module and awarded to players of the system upon the occurrences certain events. The prize expiration and reissue module may accumulate and award the expired prizes as a "secondary progressive prize" which are awarded to and shared by active players as described above. This arrangement provides an enhanced funding scheme for funding prizes for the secondary progressive prize. A similar arrangement may be used to fund the primary progressive prize.

The invention further relates to machine readable media on which are stored embodiments of the present invention. It is contemplated that any media suitable for retrieving instructions is within the scope of the present invention. By way of example, such media may take the form of magnetic, optical, or semiconductor media. The invention also relates to data structures that contain embodiments of the present invention, and to the transmission of data structures containing embodiments of the present invention.

Further advantages of the invention will be brought out in the following portions of the specification, wherein the detailed description is for the purpose of fully disclosing the preferred embodiment of the invention without placing limitations thereon.

BRIEF DESCRIPTION OF THE DRAWING

The present invention will be more fully understood by reference to the following drawings, which are for illustrative purposes only.

FIG. 13 is an example of a comparison between a traditional mystery progressive and a step down mystery progressive in accordance with one or more embodiments.

DETAILED DESCRIPTION OF THE PREFERRED EMBODIMENTS

Persons of ordinary skill in the art will realize that the following description of the present invention is illustrative only and not in any way limiting. Other embodiments of the invention will readily suggest themselves to such skilled persons having the benefit of this disclosure.

Figure 1:
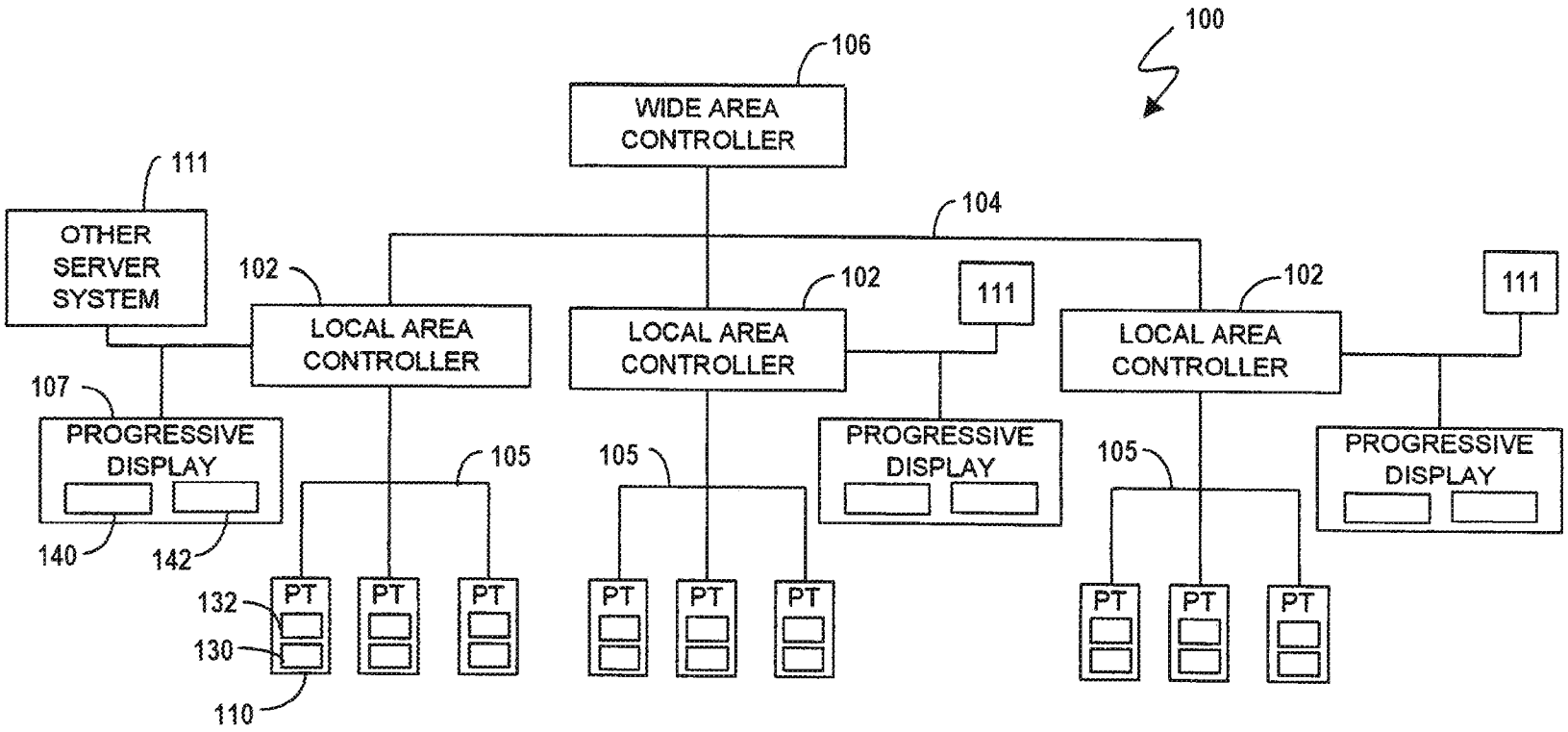
FIG. 1 is a functional block diagram depicting an example progressive system in accordance with the present invention.

Referring first to FIG. 1, there is generally shown an illustrative progressive system 100 suitable for use with the present invention. The system 100 comprises a plurality of local area controllers 102, each operating in a local network 105, and plurality of gaming devices (or player terminals) 110, each operatively coupled for communication with a respective local area controller 102 via respective local network 105.

A progressive display 107 is provided on each local network 105 and is operatively coupled to the local area controller 102 for display of a primary jackpot progressive prize 140 and at least one secondary jackpot progressive prize 142. As described in more detail below, the primary jackpot progressive prize 140 is awarded to the player triggering the progressive payout event. The secondary jackpot progressive prize 142 is awarded to other eligible players as described more fully below. The prizes 142 and 140 are normally funded by play of the gaming devices 110 (e.g., a percentage of wagers, or from the pay table) and are generally displayed to the users via progressive display 107. Other means for funding the progressive prize are also suitable for use with the invention, such as funding the progressive prize through a marketing budget, for example. As described in another embodiment below, the secondary prize 142 may also be funded using "expired" awards (e.g., expired points, coupons, etc.), rather than through wagers placed at the gaming devices 110.

Each local area controller 102 may further be coupled to a wide area controller 106 via a suitable communication connection (e.g., wide area network, frame relay). Under such an arrangement, each of the gaming devices 110 in each network 105 contribute to the primary jackpot progressive prize 140 and the secondary jackpot progressive prize 142, which are each displayed at the local networks 105. Each local network 105 may reside at a separate site or casino location from the other local network, thereby allowing broader participation among players visiting the various sits or locations. Additionally, with greater participation, the jackpots prizes 140 and 142 accumulate to higher totals at a faster rate.

Other server systems 111 may also be provided for each network 105. Other sever systems 111 may include player tracking systems or accounting systems, for example. In accordance with one embodiment of the present invention, the other server systems 111 may also include a prize server system executing prize expiration and reissue module which is configured to track expirable and/or expired prizes, which may be used to fund the progressive awards, as described more fully below.

Figure 2:
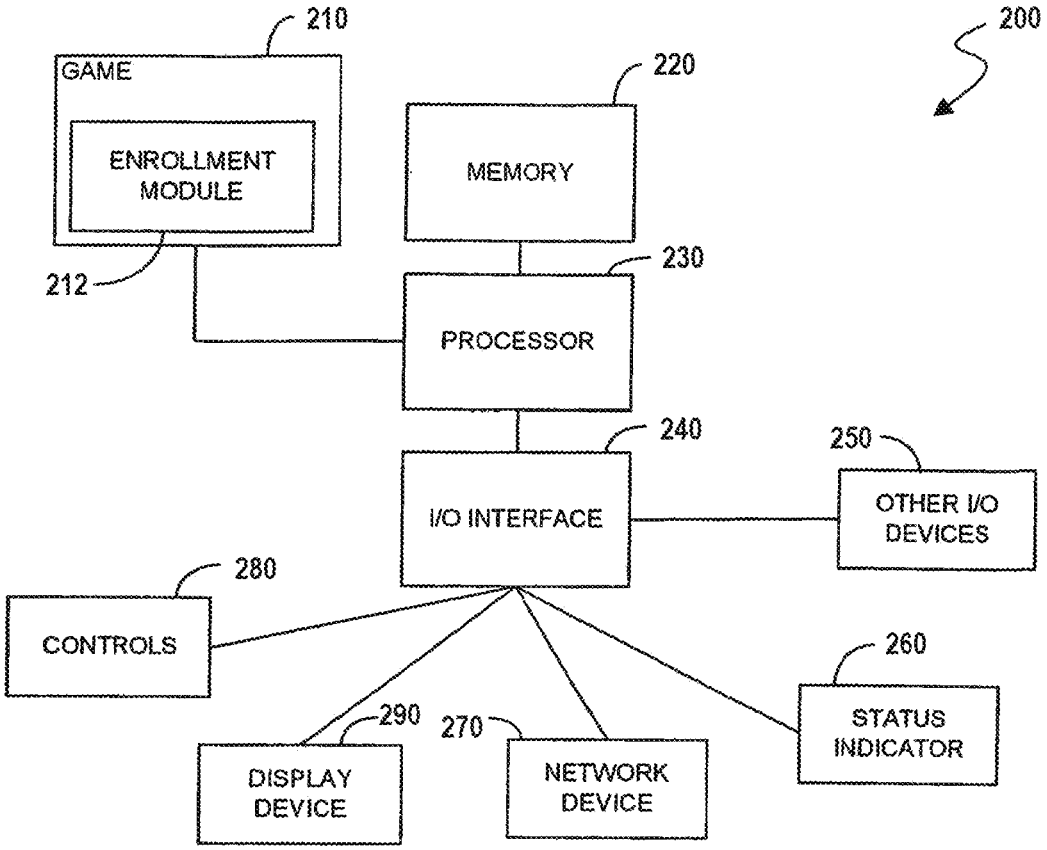
FIG. 2 is a functional block diagram depicting a gaming device in accordance with the present invention.

Referring next to FIG. 2, there is generally shown a block diagram of an example gaming device 200 having a processor 230 coupled to a memory 220 suitable for executing an enrolment module 212. The enrolment module 212 is generally provided as part of the instructions/programming provided with the game 210, which is played on the gaming device 200. The game 210 generally includes a primary (or base) game and may also include a secondary (or bonus) game. The game 210 and the enrolment module 212 are normally provided as software instructions stored on a memory 220 (such as an EPROM or other storage) which is read and executed by the processor 230 during operation. The operation of the enrolment module 212 is described more fully below.

The gaming device 200 is generally described herein as a conventional gaming machine, such as a slot machine, poker machine, keno machine, bingo machine, video lottery machine, and other like gaming device, although the enrolment module 212 is equally suitable for use with "table" games, where the functions are carried out in conjunction with management by a table attendant or dealer.

The gaming device 200 further comprises an input/output (I/O) interface 240 which is coupled for communication with the processor 230. The I/O interface 240 allows a player to interact (i.e., provide input controls and receive output signals) with the game 210 and the processes of the enrolment module 212 executed by the processor 230 via a plurality of devices, generally designated as controls 280, display device 290, status indicator 260, network device 270, ant other I/O devices 250, each of which are operatively coupled for communication to the I/O interface 240.

The controls 280 generally comprise input buttons, switches, touch-screen controls, and/or other input controls to allow a player to provide game input to the gaming device 200 such as player options, selections, game commands, among others. The display device 290 generally comprises a monitor or other video output device (e.g., LCD panel) for communicating game output information to the player. The status indicator 260, as described more fully below, provides a display or indicator to the player and indicates status information to the player (e.g., player status, active status time remaining). The network device 270 generally comprises a communication device such as a network card or serial device for communicating with other network devices (e.g., back-end servers) via a network which is generally coupled to the network device 270. Other I/O devices 250 may also be provided, such as speakers, lights, alarms, etc.

The enrolment module 212 which is executed by the processor 230 carries out several operations to track and maintain the player's status. As noted above, various criteria may be used to define a player's eligibility for sharing in the secondary progressive prize 142 (FIG. 1). For example, a player may be required to place a wager (or specific type of wager such as "maximum bet") within a certain time period after completing the previous game. The enrolment module 212 monitors the gaming device 200 to determine whether the requirements for eligibility have been met. The enrolment module 212 also indicates the player's status through the status indicator 122 (FIG. 1). The enrolment module 212 further notifies the player when the player's status is about to expire or change from "active" to "inactive." Various warnings using visual display indicators (status indicator 260) and/or sound output devices (e.g., speakers) may be used to alert the user. Example display indicators are described below in conjunction with FIGS. 6 and 7.

Figure 3:
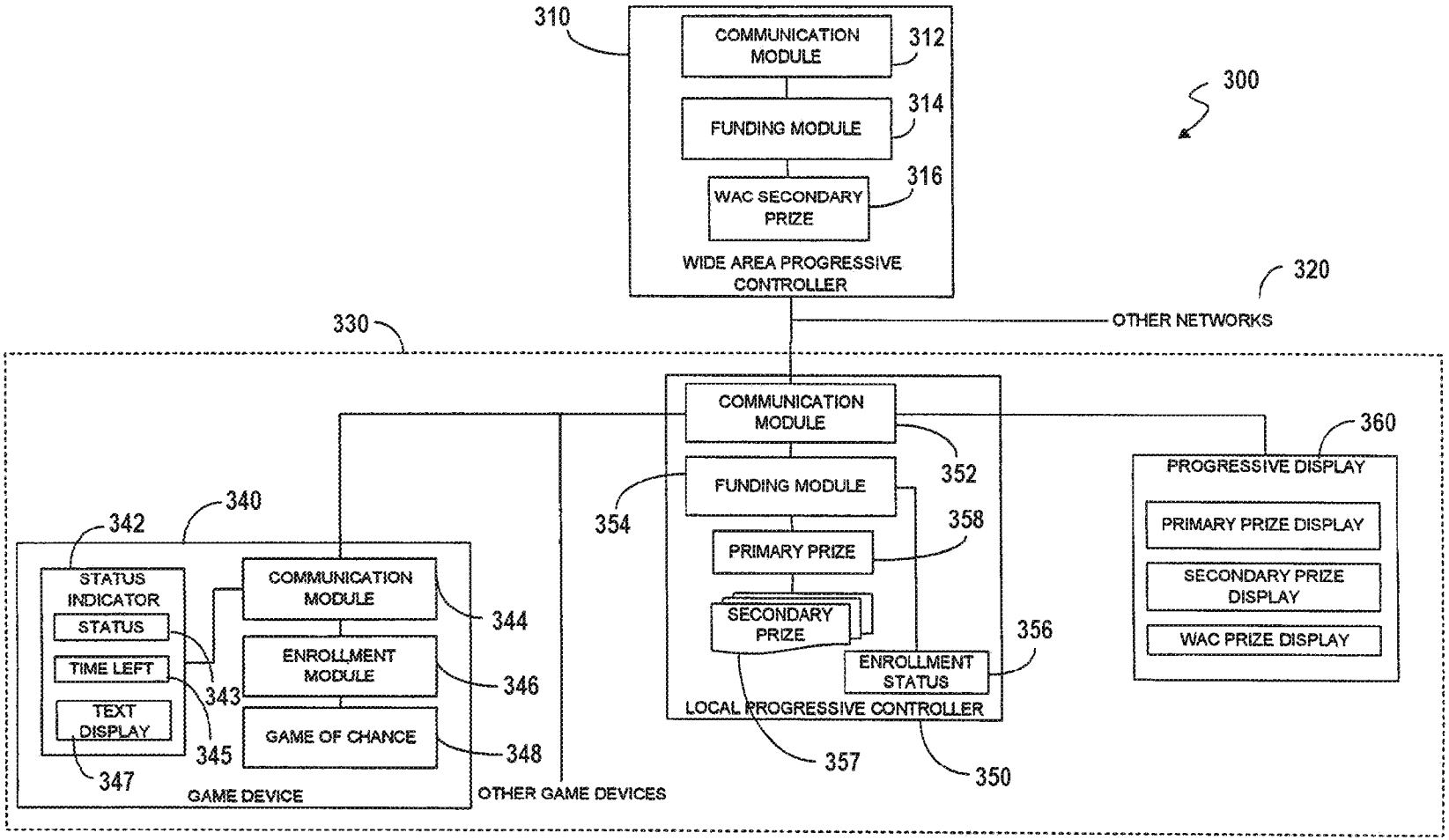
FIG. 3 is a functional block diagram depicting a second example progressive system in accordance with the present invention.

Referring now to FIG. 3, another illustrative system 300 is shown including a wide area progressive prize 316. Under this arrangement, three progressive prizes are made available at each local casino network 330: a primary prize 358, at least one secondary prize 357, and at least one "Wide Area Prize" (WAP) 316. A progressive display 360 at the local casino 330 may be used to display the amounts of each of the progressive prizes. The local casino networks 330 (and other local casino networks 320) are coupled for communication with a central wide area progressive controller 310, through a network communication system, such as a wide area network (WAN) system. A communication module 352 operating within each of the wide area controllers 310, the local controllers 350, and the gaming devices 340 enable network communication between the devices of the system. In general, the communication module 352 comprises suitable network hardware (e.g., network interface cards, cabling) and software (e.g., communication software, protocols, network drivers) to enable communication between data processing devices.

At the local casino network 330 level, the primary prize 358 and secondary prize 357 may be funded using a progressive funding model as described above (e.g., using a percentage of wagers from gaming devices from the local casino network 330, marketing funds, etc.) by a funding module 354 executed by a local progressive controller 350. At the wide area level, the WAC prize 316 may be funded using a similar funding scheme (e.g., using a percentage of wagers made from gaming devices from all of the local networks 330; 320) by the funding module 354 executed by the wide area progressive controller 310. The WAC prize 316 may be defined as a primary prize in which case it is won by the player triggering the progressive win event; or it may be defined as a secondary prize in which case it is shared by all active players (from all networks 330; 320) in the occurrence of a progressive win event. In other embodiments, the system 300 may define two WAC prizes, one of which is a primary prize, the other which is a secondary prize.

The gaming devices 340 include a status indicator 342 to display the status of the player. In the example status indicator 342, the status indicator comprises a status display 343, a time left display 345, and a text display 347. The status display 343 indicates either a status of "active" or "inactive." The time left display 345 displays the time left (e.g., in seconds) before the player's status changes form "active" to "inactive." The text display 347 may be used to indicate text messages to the player, such as a warning message that the player's active status is expiring, for example. The game device 340 communicates with the local progressive controller 350 to communicate, among other things, the player's status. This status information is maintained by the local controller 350 in an enrolment status database 356. Under this arrangement, the status of the player can be ascertained and verified by the gaming device 340 and/or the local controller 350, either together or independent of the other.

Figure 6A:
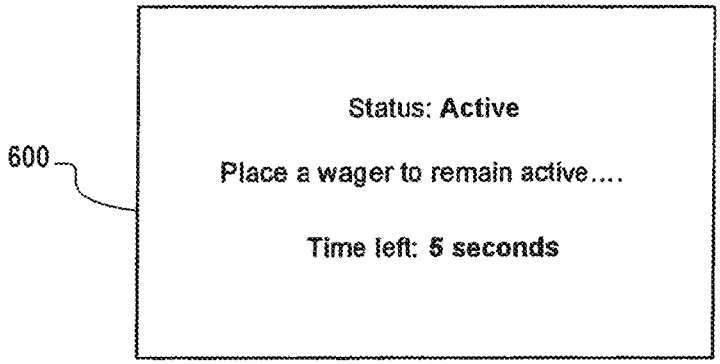
FIGS. 6A, 6B, 7A, 7B, and 7C depict example status display indicators suitable for use with the present invention.
Figure 6B:
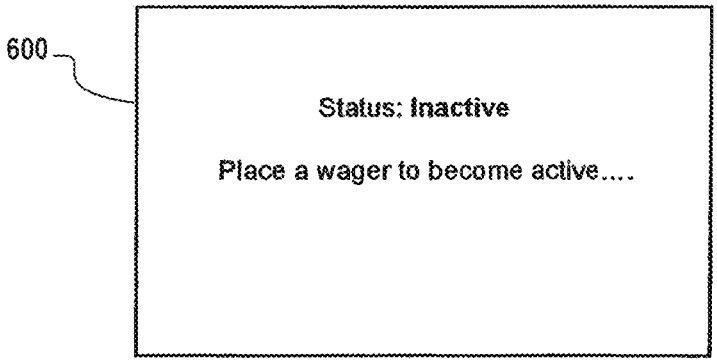

Referring next to FIG. 6A and FIG. 6B, example status indicator displays 600 are shown. In FIG. 6A, the player's status is indicated as "Active." The display 600 further indicates that the player's status is only in effect for a time period (e.g., five (5) more seconds), and that the player must place a wager within that time period in order to remain "active" status. In FIG. 6B, the player's status is indicated as "Inactive." The display 600 further indicates that the player must place a wager in order to become "active" status. Display 600 may be shown in a gaming device using separate display devices or may be shown occupying a portion of the main display of the gaming device.

Figure 7A:
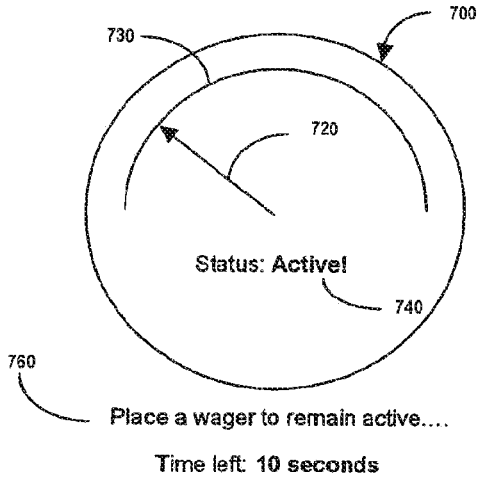
Figure 7B:
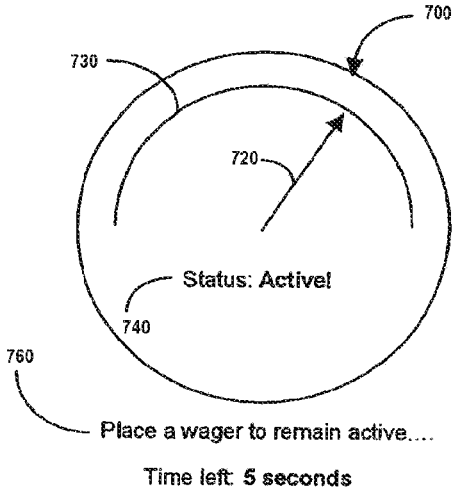
Figure 7C:
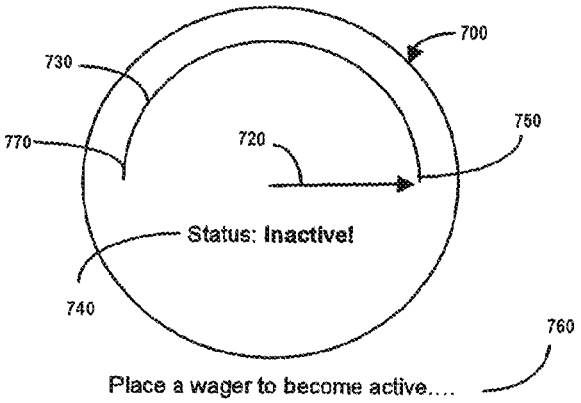

Referring now to FIG. 7A through 7C, additional example status displays 700 representing analog gauges are shown. The gauges 700 may be physical analog devices controlled by the gaming device or may be a graphical representation of an analog display on a display device. The display 700 includes a movable needle 720 which rotates to define the active/inactive status of the player as well as the time period remaining for active status. Markings 730 define the time period remaining for active status as the needle sweeps from one end 770 to the inactive end 750. Text indicator 760 defines the player's status as either "active" (FIG. 7A and FIG. 7B) or "inactive" (FIG. 7C). Text indicator 760 further inform the player that the player's status is only in effect for a time period (e.g., 10 seconds in FIG. 7A, 5 seconds in FIG. 7B), and that the player must place a wager within that time period in order to remain "active" status. In FIG. 7C, the needle 720 rests in the inactive position when the status of the game/player is "inactive"; text indicator 760 further indicates that the player must place a wager in order to become "active" status.

Figure 4:
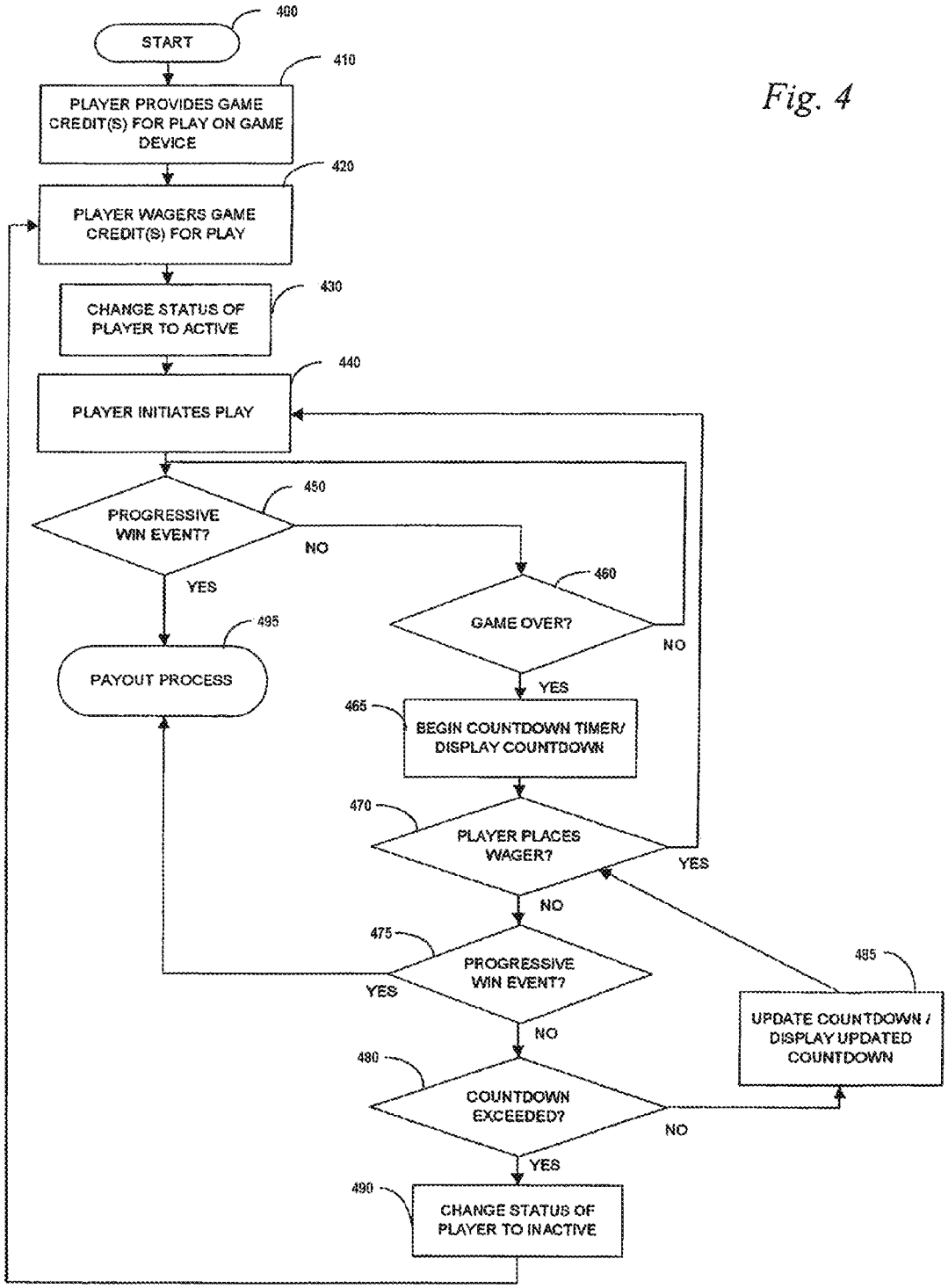
FIG. 4 is a logical flow diagram depicting an example process for providing a primary and secondary progressive prize in accordance with the present invention.
Figure 5:
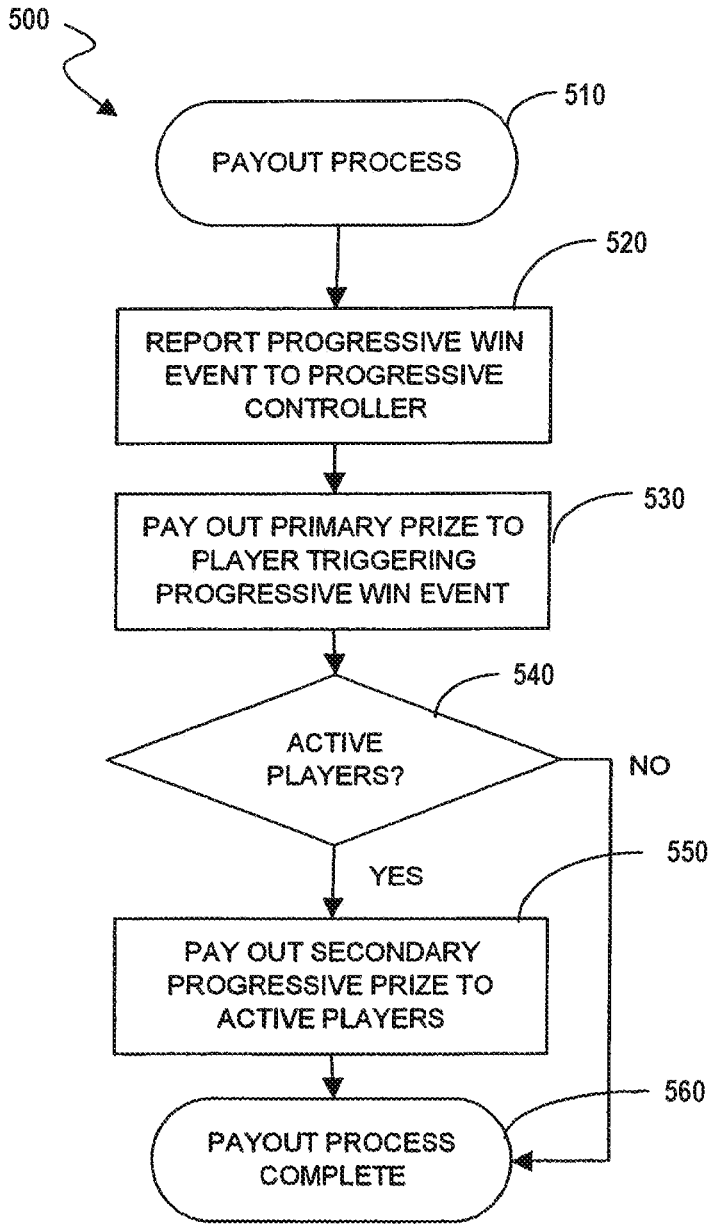
FIG. 5 is logical flow diagram depicting an example process for paying out a primary and secondary progressive prize in accordance with the present invention.

The method and operation of invention will be more fully understood with reference to the logical flow diagrams of FIG. 4 and FIG. 5, as well as FIG. 1 through FIG. 3, and FIG. 6 and FIG. 7. The order of actions as shown in FIG. 2 and FIG. 3 and described below is only illustrative, and should not be considered limiting.

FIG. 4 is a flow diagram showing an example process associated with providing a primary progressive prize and a shared progressive prize in accordance with the present invention. In this example process, the requirements for "active" status necessitates placing a predefined wager (e.g., at least one credit, maximum bet) within a time limit (e.g., within twenty (20) seconds from the conclusion of the previous game). As described above, various other criteria may be used to define "active" status and "inactive" status which are anticipated for use with present invention. This process starts at block 400 where a gaming device is provided for play in a casino environment. Initially, the gaming device initiates a player's state to "inactive." Thus the status display will initially indicate the player's state as inactive.

At block 410, a player provides game credits for play on the gaming device. The game credits are normally credited to a credit meter and tracked by the gaming device for use in placing wagers. Various means for providing game credits may be used such as through bill acceptors/coin acceptors; cashless devices (e.g., player accounts, ticket accounts, bank accounts), among other.

At block 420, the player wagers one or more credits for play on the gaming device. As described above in some embodiments, a percentage of the wager may be used to fund the local progressive prize (primary and/or shared secondary) and/or the WAC progressive prize 52 (primary and/or shared secondary). In other embodiments, the primary and/or shared progressive prizes (whether local or WAC) may be funded from expired prizes (e.g., points, prizes, coupons, etc.).

Next at block 430, the player's status is changed to active if the requisite wager (e.g., at least one credit, maximum bet) is placed by the player at block 420. The status indicator is also updated to reflect the player's "active" status. The gaming device may communicate this change of status to the local controller to update the player's status in the enrolment status database. Any countdown timers which are counting down are also reset/stopped until the game has concluded.

At block 440, the player initiates game play, normally by pressing a button or pulling a handle. The game of chance in then played in accordance with the rules of the game.

At decision block 450, a determination is made whether a progressive win event has occurred. As described above, the progressive win event may be conditioned upon play of the gaming device or may be centrally determined (e.g., by the local controller). If a progressive win event has occurred, block 495 is carried out and the payout process is initiated. This payout process is described more fully below in conjunction with FIG. 5. If a progressive win event does not occur during play of the gaming device, decision block 460 is then carried out.

At decision block 460, a determination is made whether the game of chance is over. If so, block 465 is then carried out. Otherwise, decision block 450 is repeated.

At block 465, the play of the gaming device has concluded. The countdown timer (e.g., example countdown timers of FIG. 6 and FIG. 7) is reset and started. As described above, the countdown timer may be used to indicate the time remaining before the player's status changes to "inactive." Associated text displays may be used to communicate what the player must to do remain active (e.g., place a wager).

At decision block 470, a determination is made whether the player places a wager. If the player places a wager, block 440 is then carried out to play the next game. If not decision block 475 is then carried out.

At decision block 475, a determination is made whether a progressive win event has occurred. For example, another player playing a different gaming device may trigger a progressive win event. Other events may be also be used for triggering the progressive win event as discussed above. If a progressive win event has occurred, the player is an active player and qualifies for the shared progressive prize. The payout prize is then carried out at block 495 and as described more fully below in conjunction with FIG. 5. If a progressive win event has not occurred, decision block 480 is then carried out.

At decision block 480, the enrolment module determines whether the countdown has been exceeded. If so, block 490 is then carried out. Otherwise block 485 is then carried out.

At block 490, the countdown has not been exceeded, and the player's status is changed to "inactive." The status display is updated to reflect the change of status. Block 420 is then repeated when a player places a wager. The gaming device may communicate this change of status to the local controller to update the player's status in the enrolment status database.

Referring now to FIG. 5, a logical flow diagram describing the payout process 500 in accordance with the present invention is generally shown.

Block 510 is triggered from either block 450 or block 475 of FIG. 4 upon the occurrence of the progressive win event.

At block 520, the progressive win is reported to the progressive controller. The communication is typically sent by the gaming device 10 on which the progressive win event occurs.

At block 530, the primary prize is paid to the player triggering the progressive win event. Normally this involves a casino attendant providing a "hand-pay" of the progressive amount to the player. "Hand-pay" for purposes of this application generally means the conventional understanding in the industry (e.g., completing the transaction away from gaming device between the player and a casino attendant and an exchange of documentation or forms).

At decision block 540, a determination is made whether there are any active players. This determination can be made from the enrolment status database and/or by querying each of the gaming devices participating in the system. If there are any active players, block 550 is then carried out. In some cases there will always be an active player if the player triggering the progressive win event qualifies as an active player.

The shared secondary prize is paid to each of the active players. If the shared secondary prize is in the form of credits or monies, the value may be directly credited to the meter of the gaming device. In other cases, the shared amount may be paid by the attendant as a "hand-pay." In the example embodiment where the player receives expired points, coupons, prizes, the player may be issued the points, coupons, prizes, etc. through vouchers or other account systems. The expiration for the newly issued points, coupons, prizes, etc. is reset for a new expiration term.

At block 560 the payout process is completed and processing continues according to FIG. 4, as described above. The payout process may be used to payout both local prizes as well as WAC prizes, whether primary or shared secondary.

As described above, the secondary progressive prize may be funded using expired (or expiring) prizes (coupons, points, game pieces, etc.). By way of illustration, an example embodiment using a simple point structure is described herein, although embodiments utilizing other formats (coupons, game pieces, vouchers, etc.) are suitable for use with the present invention.

The expired points arrangement provides that points may be accumulated and earned by a player during normal game play of a gaming device, that the points may expire after certain time periods and/or when other conditions are met, and that the expired points may be re-issued to players in the form of shared progressive awards. In some cases, the points may be awarded pursuant to criteria independent of play of the gaming device (e.g., free promotional points, comp points, etc.).

To illustrate an example point system, consider a slot machine version of a gaming device, were one of the reel symbols is a "silver" prize. Depending on the number of "silver" prizes aligning on a wagered payline, a player is awarded a number of "silver" points. The points may be accumulated by the player and once a certain number are collected, the points may be exchanged for a "silver level" prize. The points may be accumulated, for example, through a database such as a points account system, a player account system, or anonymously through a ticket/voucher system tracking points. Other prize levels, such as "gold" and "platinum" could also be implemented in a similar manner.

The points may further have an expiration period, such as thirty (30) days from issuance, for example. As described above, a "prize expiration and reissue module" operating in a local controller device or other central server machine (e.g., a prize server) may be used to track points, including expiration. Once points expire, the points may be added to a pool of points available for payout as a shared progressive prize as described above (i.e., funding the progressive prize).

Using the example "silver" prize from above, the progressive triggering event may be five (5) "silver" symbols aligned on a wagered payline with maximum bet. When the progressive win event occurs, the primary progressive prize may be awarded to the player playing the gaming device triggering the win event, while the accumulated "expired points" may be awarded (re-issued) to "active" players as the shared secondary progressive prize. Upon re-issuance of the points, the expiration period may be reset, establishing a new expiration period for the re-issued points. These points may also expire and be accumulated again into another shared secondary progressive prize. Under this arrangement, the system provides means for utilizing and awarding points which would otherwise have been expired and unused. In yet another alternative arrangement, the expired points may also be used to fund the primary progressive prize as well as or instead of the secondary shared progressive prize.

In accordance with one or more embodiments, instead of maintaining a secondary pool, a gaming machine may award certificates, for example, stock certificates, with a value of one or more shares based on predetermined pay table wins. These certificates may take any form physical or electronic. Generally their redemption value will be calculated at least in part based on the number of "shares" awarded and/or the value of the primary progressive pool.

Figure 8:
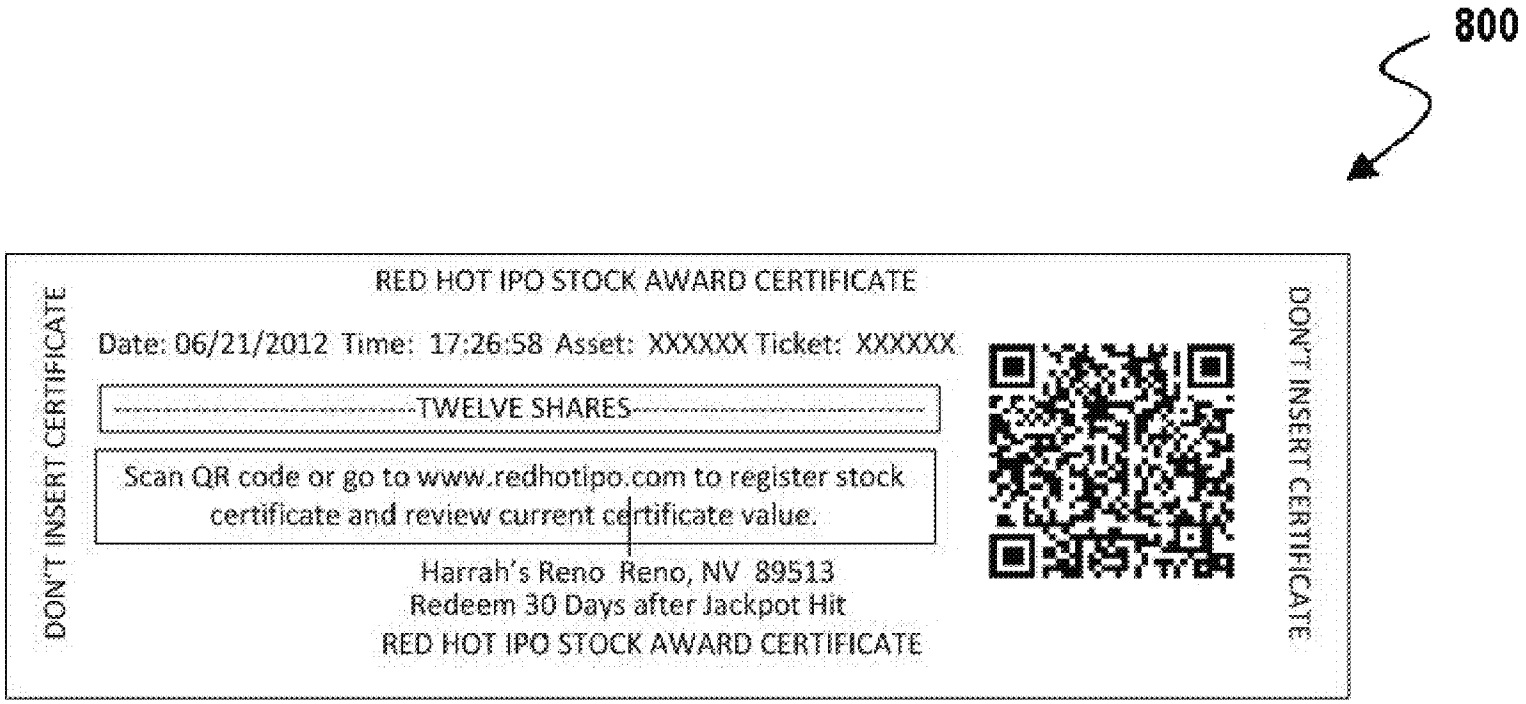
FIG. 8 is an example of a stock certificate in accordance with one embodiment of the invention.

For example, a stock certificate is awarded each time five "Stock Certificate" symbols line up (or any other appropriate winning events, depending on the game) on any pay line. Depending on the pay table, a stock certificate may contain more than one share. The gaming machine may print a stock certificate that the player registers at the machine or online and keeps. See, for example, the certificate 800 of FIG. 8. In some embodiments, the certificate is a virtual certificate credited an account held by the player. The player that triggers the progressive jackpot may or may not receive the actual jackpot. Instead, this player may win a fixed prize and/or certificate(s). Players holding certificates when the progressive has been triggered share in the pool or a designated portion of the pool based on the number of shares they own.

In one or more embodiments, as the game cycle proceeds, the actual progressive value, and therefore stock certificate values, accelerates in value. In some embodiments, stock certificates have volatility e.g. the system allows stock certificate values to go up and down.

In further embodiments, a new progressive contribution (step) percentage is applied when a specified contribution threshold has been met. The quantity of these contribution step percentages may be finite.

In accordance with some embodiments, when the jackpot hits, registered stock certificate holders may be automatically notified via their preferred method of communication entered during stock certificate registration. Use of social media may be a key element of this communication, For example, players may follow current stock prices of their shares on Facebook by, for example, navigating to a corresponding Facebook page, then selecting "Like" or scanning the gaming machine's QR code (located on machine cabinet or video screen) then selecting "Like". Players may then receive updates when stock certificates are won, the jackpot is triggered and/or other important information becomes available. Players may navigate to a Facebook page or website to view the current jackpot amount and certificates won and their current value; locate participating machines near them; register their stock certificates; view playing tips and the like. In accordance with one or more embodiments, players may scan their stock certificate's Quick Response (QR) code on their mobile device to register their stock certificate and announce to their social media friends that they won a stock certificate and the share quantity. When eligible, stock certificate holders return to their favorite casino to collect their share of the jackpot. Shared Progressive with Stock Certificate Value Control Option In preferred embodiments, the stock shares' value increases as the progressive jackpot increases. Stock share winners early in the game cycle will have the added excitement of seeing their stock share value increase as the progressive jackpot increases in value. This is psychologically much more powerful than disappointment when the stock share value decreases as the jackpot value increases.

Figure 9:
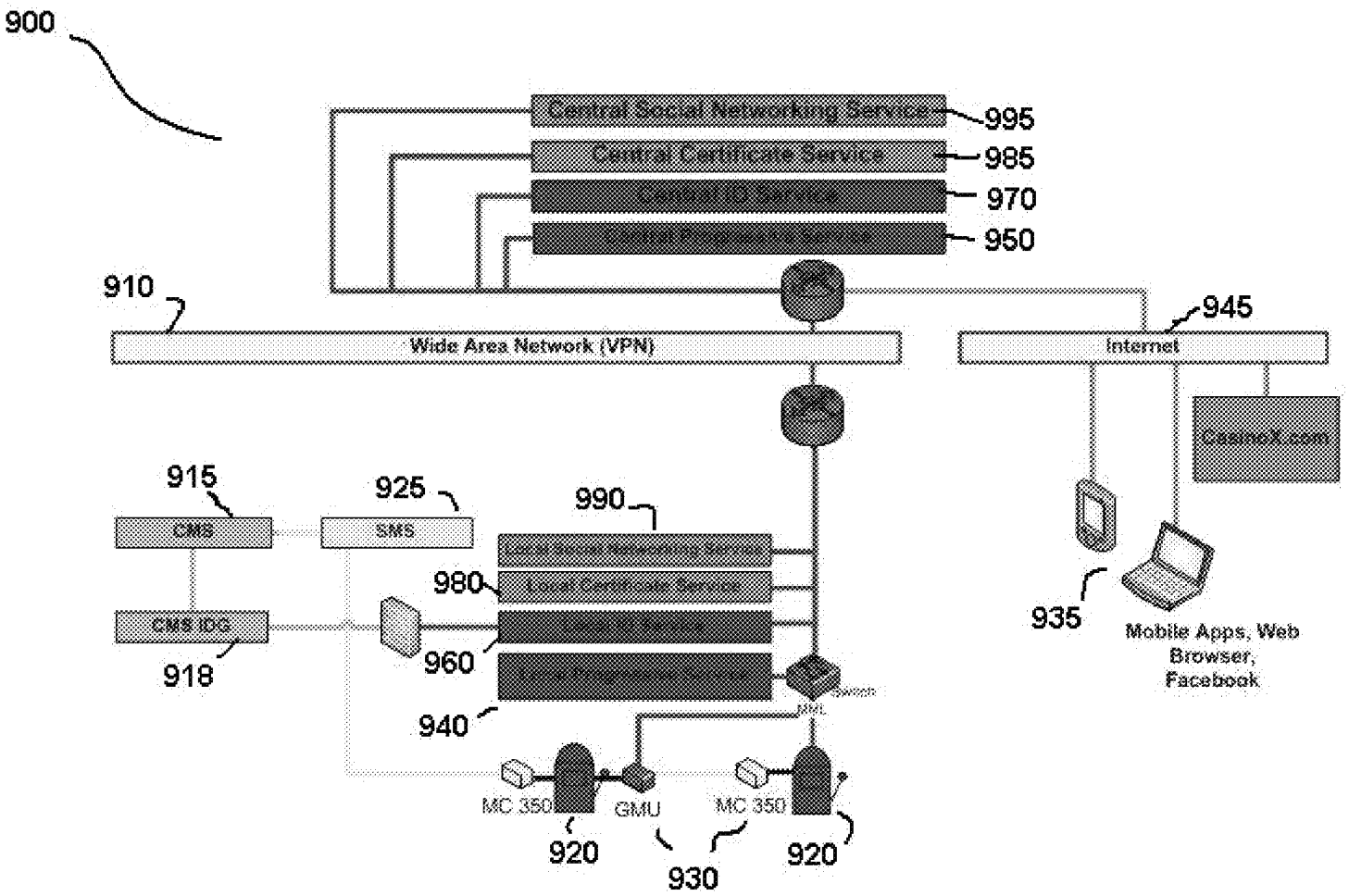
FIG. 9 illustrates an example of a network in accordance with one or more embodiments of the invention.

In accordance with one or more embodiments, FIG. 9 illustrates an example network 900 including various central, internet and local (casino) components for carrying out various aspects of the invention. The network 900 may link multiple casinos (one shown) through a wide area network such as a VPN 910 and may include, but not be limited to, gaming machines 920, game monitoring units 930 (GMU and/or Bally Mastercom 350™), local progressive 940 and central 950 progressive, local ID service 960, central ID service 970, local certificate service 980, central certificate service 985 and local 990 and central 995 social networking services. Each casino may have CMS 915 (casino management system), CMS IDG 918 and SMS 925 (slot management system) components. Various devices 935 such as mobile phones or personal computing devices running related applications such as web browsers or dedicated gaming applications may connect to the network through the internet 945 or other networks such as cellular networks.

The Local Progressive Service 940 is responsible for incrementing progressive and mystery values locally should the WAN 910 not be available. This service may be modified to support Contribution Step % changes which are explained further below.

The Local ID Service 960 is responsible for obtaining an anonymous ID from the operator's CMS 915 for tracking any specific data that may need to be persisted should the WAN 910 not be available. This data will then be forwarded to the Central ID Service when the WAN 910 connection becomes available.

The Local Certificate Service 980 may be used to create and register stock certificates should the WAN 910 not be available. This data will then be forwarded to the Central Certificate Service 985 when the WAN 910 connection becomes available.

The Local Social Networking Service 990 may be used to store key machine social messages such as stock certificate or jackpot won should the WAN 910 not be available. This data will then be forwarded to the Central Social Networking Service 995 when the WAN 910 connection becomes available.

The Central Progressive Service 950 is responsible for incrementing wide area progressive and mystery values for all participating machines across all their sites. This service may also be modified to support Contribution Step % changes.

The Central ID Service 970 is responsible for storing anonymous IDs centrally from the Operator's CMS 915 for tracking any specific data that may need to be persisted across the operator's sites.

The Central Certificate Service 985 is a central repository for stock certificates created and registered at the site level.

The Central Social Networking Service 995 is responsible for communicating machine messages to the social networks such as Facebook.

Figure 10:
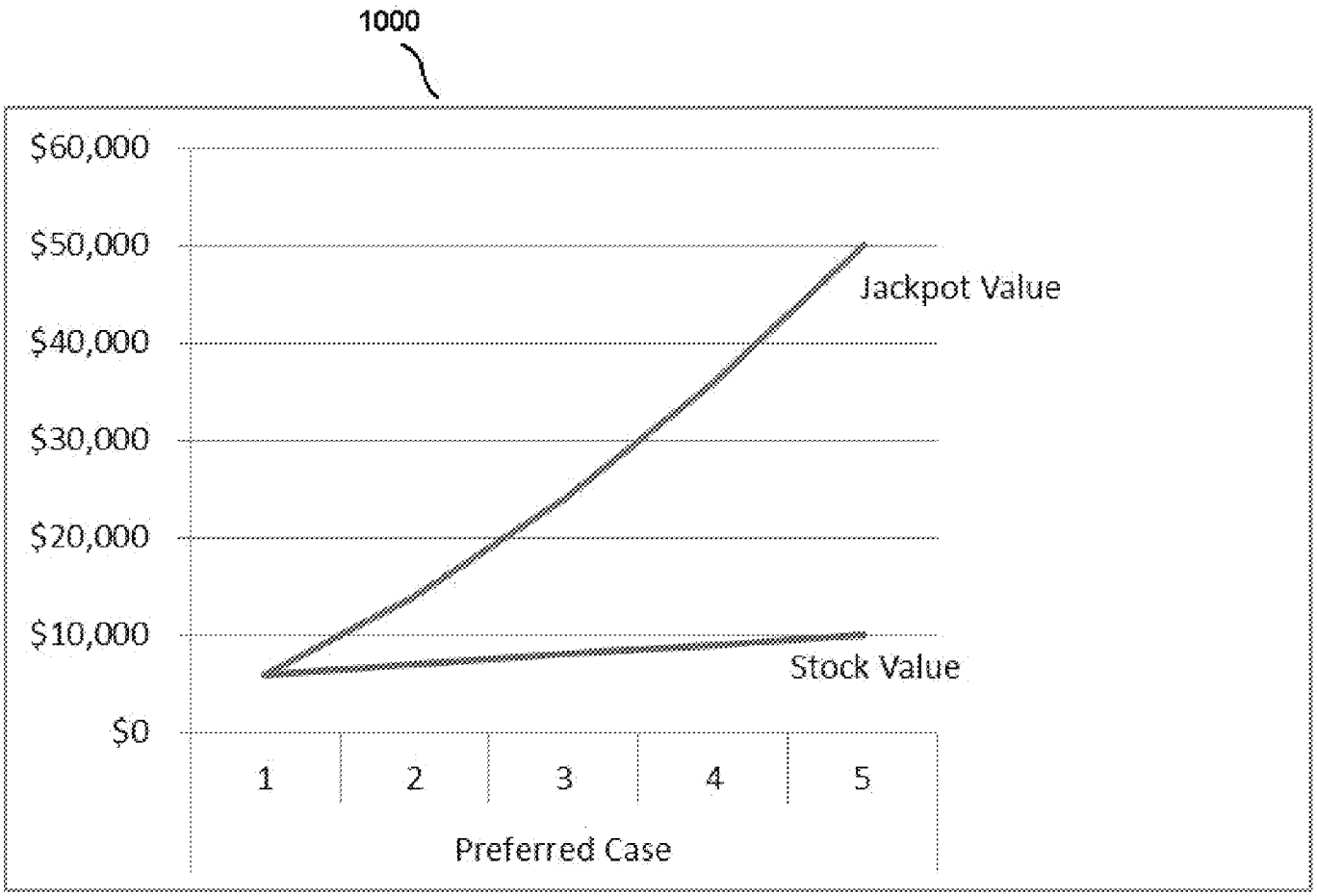
FIGS. 10 and 11 illustrate examples of stock certificate values over time in accordance with various embodiments.

In accordance with one or more embodiments, FIG. 10 illustrates an example 1000 that assumes no control of the stock certificate value behavior. In the example, the progressive jackpot resets at $5,000. Its associated game cycle is designed so that the progressive jackpot hits at $50,000 on average. The game is designed to generate 5 stock certificates during this same game cycle. On average, each stock certificate would thus be worth $10,000.00 when the jackpot hits ($50,000 progressive jackpot/5 stock certificates). It is possible for the stock value to go up which leads to a more positive experience and is the preferred case.

TABLE 1

| | Preferred Case | | | | |
|---|---|---|---|---|---|
| | 1 | 2 | 3 | 4 | 5 |
| Jackpot Value | $6,000 | $14,000 | $24,000 | $36,000 | $50,000 |
| Stock Value | $6,000 | $ 7,000 | $ 8,000 | $ 9,000 | $10,000 |

Figure 11:
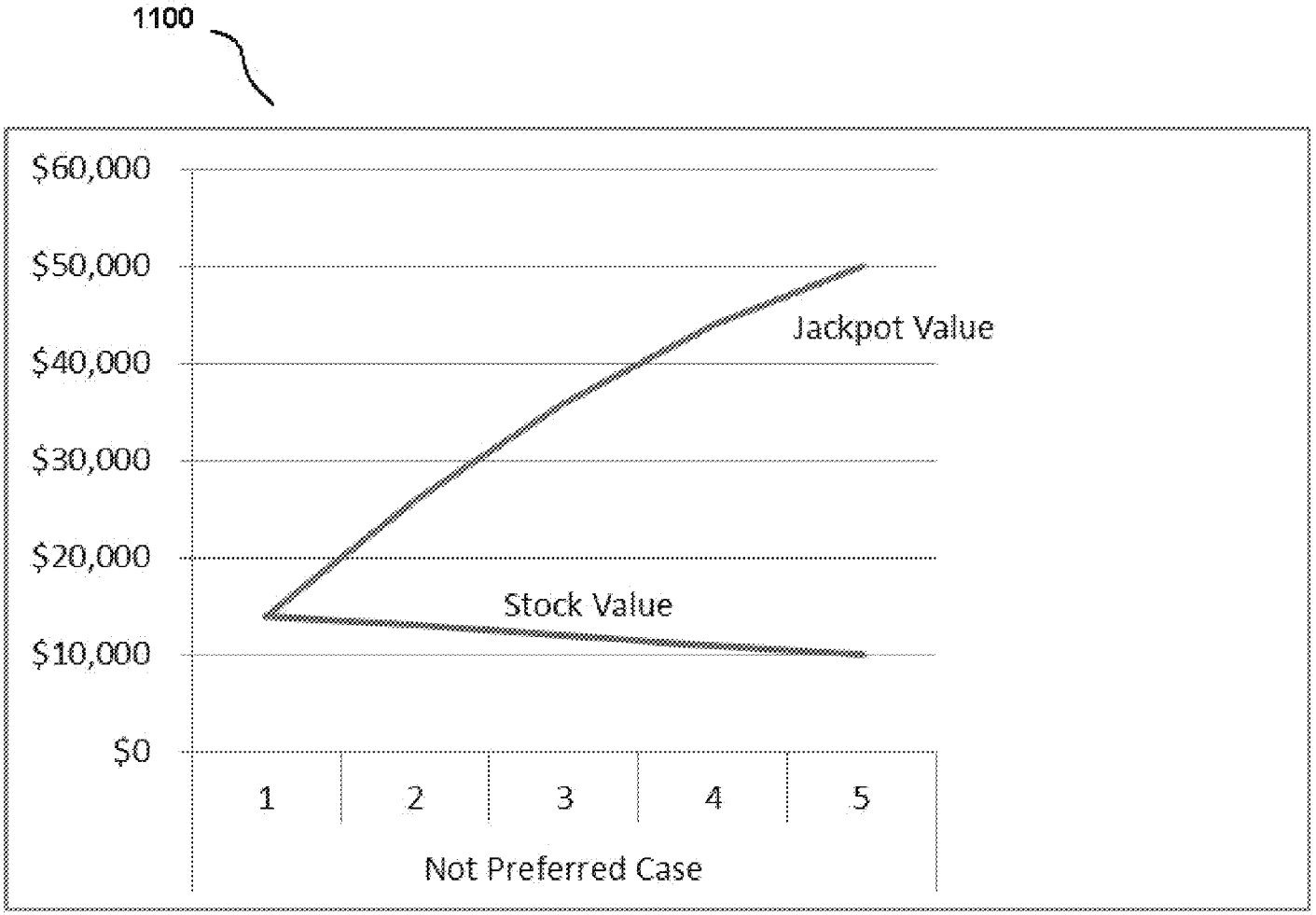

It is also quite possible for the stock value to go down, as illustrated in the example 1100 of FIG. 11 in accordance with one or more embodiments, which leads to a more negative experience and is not preferred:

TABLE 2

| | Non-Preferred Case | | | | |
|---|---|---|---|---|---|
| | 1 | 2 | 3 | 4 | 5 |
| Jackpot Value | $14,000 | $26,000 | $36,000 | $44,000 | $50,000 |
| Stock Value | $14,000 | $13,000 | $12,000 | $11,000 | $10,000 |

It would be much more interesting if stock certificates were always worth less at the beginning of the game cycle and appreciated towards the end of the game cycle.

Figure 12:
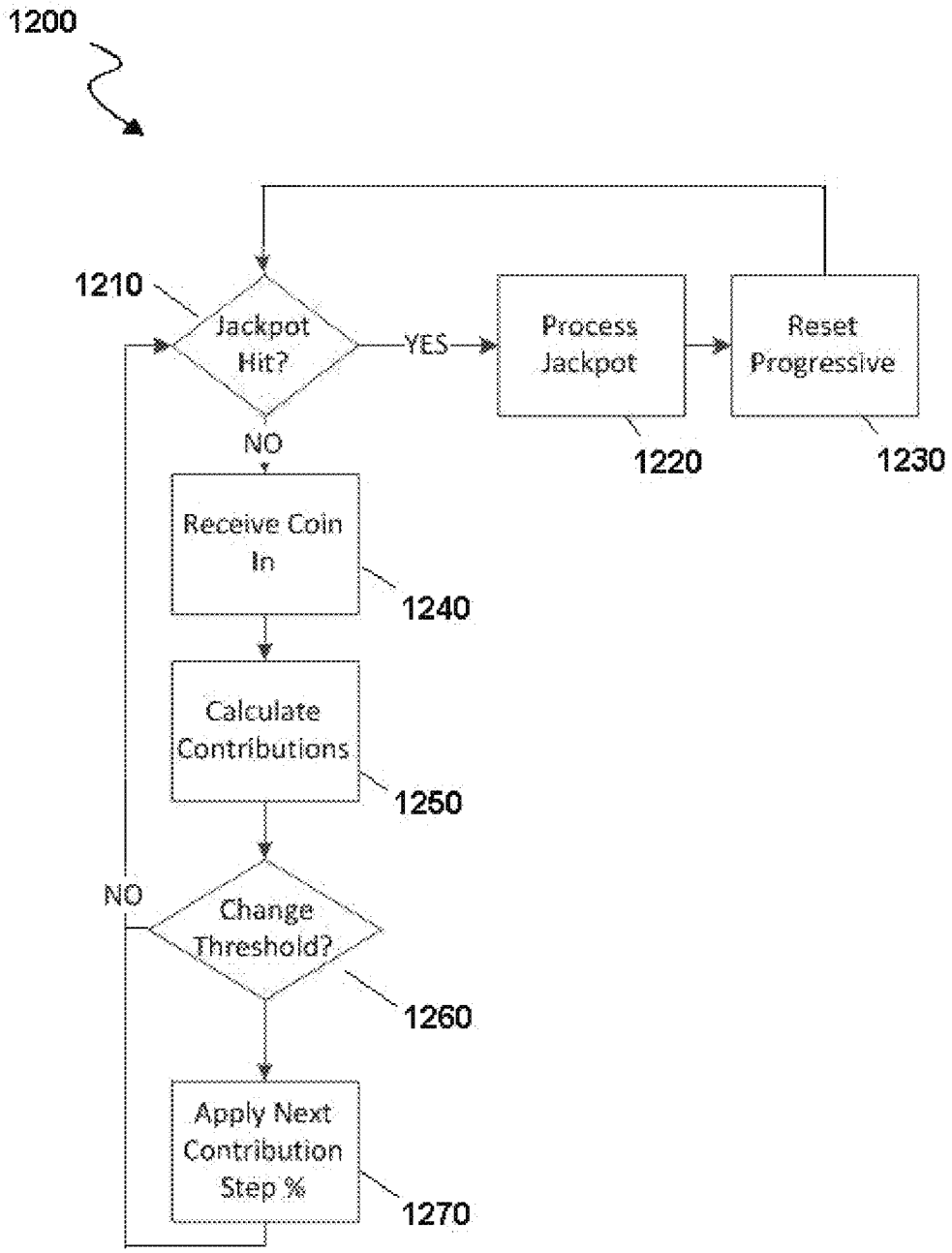
FIG. 12 illustrates an example of a method of practicing one or more embodiments of the invention.

As illustrated by the method 1200 of FIG. 12, in accordance with one or more embodiments, the following tables exemplify applying different progressive jackpot contribution percentages when a contribution threshold has been met. For example, the method determines if a jackpot has been hit at decision diamond 1210. If it has, the jackpot is processed at box 1220, reset at box 1230 and play continues at decision diamond 1210. If a jackpot has not been hit, as is more commonly the case, the game receives coin-in/wagers at box 1240. At box 1250, a percentage of the wager is siphoned off as contributions to the progressive. At decision diamond 1260, a determination is made to see if a contribution threshold has been reached. For example, when contributions reach the $5,000.00 threshold (and theoretically one stock certificate should have been won), the Contribution Step Percentage can be configured to change from 2.5% to 4% in the progressive system at box 1270. This functionality can be available for both machine progressives (machine-triggered) and mysteries (system-triggered).

TABLE 3

| | | | | | |
|---|---|---|---|---|---|
| Minimum Bet | $ 1.00 | | | | |
| Average Bet | $ 1.00 | | | | |
| Jackpot Reset | 1,000 | | | | |
| Stock Certificates Per Cycle | 5 | | | | |
| Jackpot Cycle | 985,714 | | | | |
| Stock Certificates Outstanding | 1 | 2 | 3 | 4 | 5 |
| Jackpot Value Goal | $ 6,000 | $ 14,000 | $ 24,000 | $ 36,000 | $ 50,000 |
| Stock Value Goal | $ 6,000 | $ 7,000 | $ 8,000 | $ 9,000 | $ 10,000 |
| Contributions Begin | 0.0001 | 5,000.0001 | 13,000.0001 | 23,000.0001 | 35,000.0001 |
| Contributions End | 5,000.0000 | 13,000.0000 | 23,000.0000 | 35,000.0000 | 49,000.0000 |
| Games Played at Average Bet | 200,000 | 200,000 | 200,000 | 200,000 | 185,714 |
| Contribution Step Percentage | 2.50% | 4.00% | 5.00% | 6.00% | 7.00% |
| Jackpot Value Actual | $ 6,000 | $ 14,000 | $ 24,000 | $ 36,000 | $ 50,000 |
| Stock Value Actual | $ 6,000 | $ 7,000 | $ 8,000 | $ 9,000 | $ 10,000 |
| Average Contribution Rate % | 4.97% | | | | |
| Average Contribution Rate % + Reset | 5.07% | | | | |

For the machine progressive case, after the $49,000 threshold is reached, the progressive system could be configured to change from 7.00% to 4.97% (Average Contribution Rate %) to maintain correct payback percentage at box 1260 when the jackpot is overdue.

For the mystery case below, the contribution step percentages can be followed until the contribution "end" value (22,989.00) matches the pre-selected random mystery trigger (22,989.00), at which point the jackpot would be hit at decision diamond 1210.

TABLE 4

| Accelerated Mystery with Contributions Ending at Mystery Random Trigger | | | | | |
|---|---|---|---|---|---|
| Random Mystery Trigger | 22,989.00 | | | | |
| Minimum Bet | $ 1.00 | | | | |
| Average Bet | $ 1.00 | | | | |
| Jackpot Reset | 1,000 | | | | |
| Stock Certificates Per Cycle | 5 | | | | |
| Jackpot Cycle | 599,780 | | | | |
| Stock Certificates Outstanding | 1 | 2 | 3 | 4 | 5 |
| Jackpot Value Goal | $ 6,000 | $ 14,000 | $ 24,000 | NA | NA |
| Stock Value Goal | $ 6,000 | $ 7,000 | $ 8,000 | NA | NA |
| Contributions Begin | 0.0001 | 5,000.0001 | 13,000.0001 | NA | NA |
| Contributions End | 5,000.0000 | 13,000.0000 | 22,989.0000 | NA | NA |
| Games Played at Average Bet | 200,000 | 200,000 | 199,780 | NA | NA |

TABLE 4-continued

| Accelerated Mystery with Contributions Ending at Mystery Random Trigger | | | | | |
|---|---|---|---|---|---|
| Contribution Step Percentage | 2.50% | 4.00% | 5.00% | NA | NA |
| Jackpot Value Actual | $6,000 | $14,000 | $23,989 | NA | NA |
| Stock Value Actual | $6,000 | $ 7,000 | $ 7,996 | NA | NA |
| Average Contribution % | 3.83% | | | | |
| Average Contribution % + Reset | 4.00% | | | | |

Additionally, for the mystery case below, the Contribution Ends could be adjusted as a ratio of a Contribution Distribution Goal as a percentage of the Random Mystery Trigger (22,989.00):

TABLE 5

| Accelerated Mystery with Contributions Ending at Random Mystery Trigger and Step Percentages Prorated | | | | | |
|---|---|---|---|---|---|
| Random Mystery Trigger | 22,989.00 | | | | |
| Minimum Bet | $ 1.00 | | | | |
| Average Bet | $ 1.00 | | | | |
| Jackpot Reset | 1,000 | | | | |
| Stock Certificates Per Cycle | 5 | | | | |
| Jackpot Cycle | 469,167 | | | | |
| Stock Certificates Outstanding | 1 | 2 | 3 | 4 | 5 |
| Contribution Distribution Goal | 0.102040816 | 0.163265306 | 0.204081633 | 0.244897959 | 0.285714286 |
| Contributions Begin | 0.0250 | 2,345.8164 | 6,099.1236 | 10,790.7564 | 16420.71569 |
| Contributions End | 2,345.8163 | 6,099.1235 | 10,790.7563 | 16420.71559 | 22989.0014 |
| Games Played at Average Bet | 93,833 | 93,834 | 93,834 | 93,834 | 93,834 |
| Contribution Step Percentage | 2.50% | 4.00% | 5.00% | 6.00% | 7.00% |
| Jackpot Value Actual | $ 3,346 | $ 7,099 | $11,791 | $16,421 | $22,989 |
| Stock Value Actual | $ 3,346 | $ 3,550 | $ 3,930 | $ 4,105 | $ 4,598 |
| Average Contribution Rate % | 4.90% | | | | |
| Average Contribution Rate % + Reset | 5.11% | | | | |

As illustrated by Table 5, it is not necessary that each contribution step percentage configuration accelerate. They may be configured to decelerate or provide volatility.

In a traditional mystery progressive, a starting amount, a progressive rate and a minimum and maximum range within which the progressive win will be triggered are pre-selected. For example, when the mystery progressive begins, the system randomly chooses a number between the minimum and maximum range. This is kept secret. The progressive rate is used to determine the portion of the wager amount that will be contributed to the progressive amount each time a game is played. When the reset amount plus the contributions reaches the randomly chosen trigger amount, the jackpot is awarded to the game that generated the triggering contribution. In contrast, in a step-down mystery progressive in accordance with one or more embodiments of the invention, the progressive operator chooses a step down percentage or a finite number of step down progressive rates (commonly referred to as break rates). After each mystery jackpot (prize plus stock certificate) is awarded or at predefined thresholds, the progressive rate (contribution to the primary progressive pool) is reduced. The thresholds are applied to the total mystery contributions between WAP distribution events and will not be reset after each mystery (stock certificate) is won.

In order to preserve the return to player (RTP), the contributions not added to the primary progressive pool due to the progressive rate reduction (e.g. [original progressive rate—step down progressive rate] X Wager Amount) are instead added to the certificate distribution pool. Since the frequency of mystery progressives is tied to the incrementation rate of the primary progressive pool, this causes the issuance of mystery awards (e.g. certificates) to slow over time and the certificate distribution pool to grow more quickly over time. An example is illustrated in TABLE 6.

TABLE 6

| Progression | 0.9 | $104,621,499.05 | $519,757.50 |
|---|---|---|---|
| Step | Rate | Avg. Wagers to Win Certificate | Add'l Contrib to Dist. Pool |
| 0 | 0.500% | $ 10,000.00 | $ 0.00 | $ 10,000.00 |
| 1 | 0.450% | $ 11,111.11 | $ 5.56 | $ 21,111.11 |
| 2 | 0.405% | $ 12,345.68 | $ 11.73 | $ 33,456.79 |
| 3 | 0.365% | $ 13,717.42 | $ 18.59 | $ 47,174.21 |
| 4 | 0.328% | $ 15,241.58 | $ 26.21 | $ 62,415.79 |
| 5 | 0.295% | $ 16,935.09 | $ 34.68 | $ 79,350.88 |
| 6 | 0.266% | $ 18,816.76 | $ 44.08 | $ 98,167.64 |
| 7 | 0.239% | $ 20,907.52 | $ 54.54 | $ 119,075.16 |
| 8 | 0.215% | $ 23,230.57 | $ 66.15 | $ 142,305.73 |
| 9 | 0.194% | $ 25,811.75 | $ 79.06 | $ 168,117.48 |
| 10 | 0.174% | $ 28,679.72 | $ 93.40 | $ 196,797.20 |
| 11 | 0.157% | $ 31,866.36 | $ 109.33 | $ 228,663.55 |
| 12 | 0.141% | $ 35,407.06 | $ 127.04 | $ 264,070.62 |
| 13 | 0.127% | $ 39,341.18 | $ 146.71 | $ 303,411.80 |
| 14 | 0.114% | $ 43,712.42 | $ 168.56 | $ 347,124.22 |
| 15 | 0.103% | $ 48,569.36 | $ 192.85 | $ 395,693.57 |
| 16 | 0.093% | $ 53,965.95 | $ 219.83 | $ 449,659.53 |
| 17 | 0.083% | $ 59,962.17 | $ 249.81 | $ 509,621.70 |
| 18 | 0.075% | $ 66,624.63 | $ 283.12 | $ 576,246.33 |
| 19 | 0.068% | $ 74,027.37 | $ 320.14 | $ 650,273.70 |
| 20 | 0.061% | $ 82,252.63 | $ 361.26 | $ 732,526.33 |
| 21 | 0.055% | $ 91,391.81 | $ 406.96 | $ 823,918.15 |
| 22 | 0.049% | $101,546.46 | $ 457.73 | $ 925,464.61 |
| 23 | 0.044% | $112,829.40 | $ 514.15 | $1,038,294.01 |
| 24 | 0.040% | $125,366.00 | $ 576.83 | $1,163,660.01 |
| 25 | 0.036% | $139,295.56 | $ 646.48 | $1,302,955.57 |
| 26 | 0.032% | $154,772.84 | $ 723.86 | $1,457,728.41 |
| 27 | 0.029% | $171,969.82 | $ 809.85 | $1,629,698.23 |
| 28 | 0.026% | $191,077.58 | $ 905.39 | $1,820,775.81 |
| 29 | 0.024% | $212,308.42 | $1,011.54 | $2,033,084.24 |
| 30 | 0.021% | $235,898.25 | $1,129.49 | $2,268,982.49 |
| 31 | 0.019% | $262,109.17 | $1,260.55 | $2,531,091.65 |

TABLE 6-continued

| | | | | |
|---|---|---|---|---|
| 32 | 0.017% | $ 291,232.41 | $ 1,406.16 | $ 2,822,324.06 |
| 33 | 0.015% | $ 323,591.56 | $ 1,567.96 | $ 3,145,915.62 |
| 34 | 0.014% | $ 359,546.18 | $ 1,747.73 | $ 3,505,461.80 |
| 35 | 0.013% | $ 399,495.76 | $ 1,947.48 | $ 3,904,957.56 |
| 36 | 0.011% | $ 443,884.17 | $ 2,169.42 | $ 4,348,841.73 |
| 37 | 0.010% | $ 493,204.64 | $ 2,416.02 | $ 4,842,046.37 |
| 38 | 0.009% | $ 548,005.15 | $ 2,690.03 | $ 5,390,051.52 |
| 39 | 0.008% | $ 608,894.61 | $ 2,994.47 | $ 5,998,946.13 |
| 40 | 0.007% | $ 676,549.57 | $ 3,332.75 | $ 6,675,495.70 |
| 41 | 0.007% | $ 751,721.74 | $ 3,708.61 | $ 7,427,217.45 |
| 42 | 0.006% | $ 835,246.38 | $ 4,126.23 | $ 8,262,463.83 |
| 43 | 0.005% | $ 928,051.54 | $ 4,590.26 | $ 9,190,515.37 |
| 44 | 0.005% | $ 1,031,168.37 | $ 5,105.84 | $ 10,221,683.74 |
| 45 | 0.004% | $ 1,145,742.64 | $ 5,678.71 | $ 11,367,426.38 |
| 46 | 0.004% | $ 1,273,047.38 | $ 6,315.24 | $ 12,640,473.75 |
| 47 | 0.004% | $ 1,414,497.08 | $ 7,022.49 | $ 14,054,970.84 |
| 48 | 0.003% | $ 1,571,663.43 | $ 7,808.32 | $ 15,626,634.26 |
| 49 | 0.003% | $ 1,746,292.70 | $ 8,681.46 | $ 17,372,926.96 |
| 50 | 0.003% | $ 1,940,325.22 | $ 9,651.63 | $ 19,313,252.17 |
| 51 | 0.002% | $ 2,155,916.91 | $10,729.58 | $ 21,469,169.08 |
| 52 | 0.002% | $ 2,395,463.23 | $11,927.32 | $ 23,864,632.31 |
| 53 | 0.002% | $ 2,661,625.81 | $13,258.13 | $ 26,526,258.13 |
| 54 | 0.002% | $ 2,957,362.01 | $14,736.81 | $ 29,483,620.14 |
| 55 | 0.002% | $ 3,285,957.79 | $16,379.79 | $ 32,769,577.93 |
| 56 | 0.001% | $ 3,651,064.21 | $18,205.32 | $ 36,420,642.15 |
| 57 | 0.001% | $ 4,056,738.02 | $20,233.69 | $ 40,477,380.17 |
| 58 | 0.001% | $ 4,507,486.69 | $22,487.43 | $ 44,984,866.85 |
| 59 | 0.001% | $ 5,008,318.54 | $24,991.59 | $ 49,993,185.39 |
| 60 | 0.001% | $ 5,564,798.38 | $27,773.99 | $ 55,557,983.77 |
| 61 | 0.001% | $ 6,183,109.31 | $30,865.55 | $ 61,741,093.08 |
| 62 | 0.001% | $ 6,870,121.45 | $34,300.61 | $ 68,611,214.53 |
| 63 | 0.001% | $ 7,633,468.28 | $38,117.34 | $ 76,244,682.81 |
| 64 | 0.001% | $ 8,481,631.42 | $42,358.16 | $ 84,726,314.23 |
| 65 | 0.001% | $ 9,424,034.91 | $47,070.17 | $ 94,150,349.15 |
| 66 | 0.000% | $10,471,149.91 | $52,305.75 | $104,621,499.05 |
| 67 | 0.000% | $11,634,611.01 | $58,123.06 | $116,256,110.06 |
| 68 | 0.000% | $12,927,345.56 | $64,586.73 | $129,183,455.62 |
| 69 | 0.000% | $14,363,717.29 | $71,768.59 | $143,547,172.91 |
| 70 | 0.000% | $15,959,685.88 | $79,748.43 | $159,506,858.79 |

TABLE 6 provides an example for illustrative purposes. Note that the step down percentages in TABLE 6 include some truncation of the percentages, particularly near the end of the table. In practice, the step-down percentages and number of rate steps are selected so that the issuance of a mystery award does not become too infrequent near the end of the progressive cycle.

In accordance with one embodiment of the invention, FIG. 13 provides a comparison between a traditional mystery progressive 1310 and a step down mystery progressive 1320, both of which allocate 2% of each wager to the various progressive pools. In particular, note the difference between a traditional mystery average certificate value 1315 and a step-down mystery certificate value 1325.

In addition to gradually decreasing the allocation of each wager to the primary progressive pool and gradually increasing the allocation to the distribution pool, a certain amount of each wager is allocated to the reset cost for the mystery progressive. This seeds the pool from which cash awards are paid when each mystery award (stock certificate) is won. Since a step-down mystery progressive operated in accordance with this aspect of the invention gradually issues fewer mystery awards over time, an increasingly smaller percentage of each wager can be allocated to the mystery pool reset cost and can, instead, also be allocated to the distribution pool. This causes the distribution pool (and, therefore the value of each share of stock) to grow more rapidly than if mystery events occurred with a generally fixed frequency throughout the life of the progressive.

While the issuing of a stock certificate upon a mystery event is described above as being accompanied by an immediate "cash" prize payable from the mystery pool, in some embodiments, it is possible to not to award any immediate prize with the mystery award (stock certificate) and to issue just the stock certificate.

In some embodiments where no cash prize is awarded with the stock certificate, a version of the step down method may be implemented in which the number of shares awarded per certificate decreases or generally decreases over time. This allows the average time between issuance of mystery awards (stock certificates) to be held fairly constant, as opposed to gradually increasing as described above. While the number of shares awarded per certificate will generally be decreased over time, each share is typically worth more than the share value of earlier issued certificates since the distribution pool will have grown.

In one embodiment, when the distribution progressive is triggered, stock certificate holders may redeem their stock certificates for cash, check, or wire transfer. In accordance with one or other embodiments, players may be able to redeem their certificates at any time according to the current value of the certificates. In accordance with one or more embodiments, the casino may offer to purchase certificates from players holding them at a rate determined by the casino. In these cases, redeemed certificates may no longer be used to calculate the current value of any remaining certificates and the progressive pool may be reduced by the amount paid for the redeemed certificates. In some cases, the casino (or other investors including private individuals) may purchase certificates from the original winners and hold the purchased certificates and redeem them immediately or when the progressive has been triggered. If the latter, the investor will generally redeem at value higher than their purchase price from the player due to the inclination of the system to increase the value of certificates over time. In one or more embodiments, various aspects of social media sites associated with the progressive may facilitate such transactions by offering a marketplace for such transactions. In some cases, the progressive operator, much like a stock broker, may extract a commission from such transactions.

Figure 14:
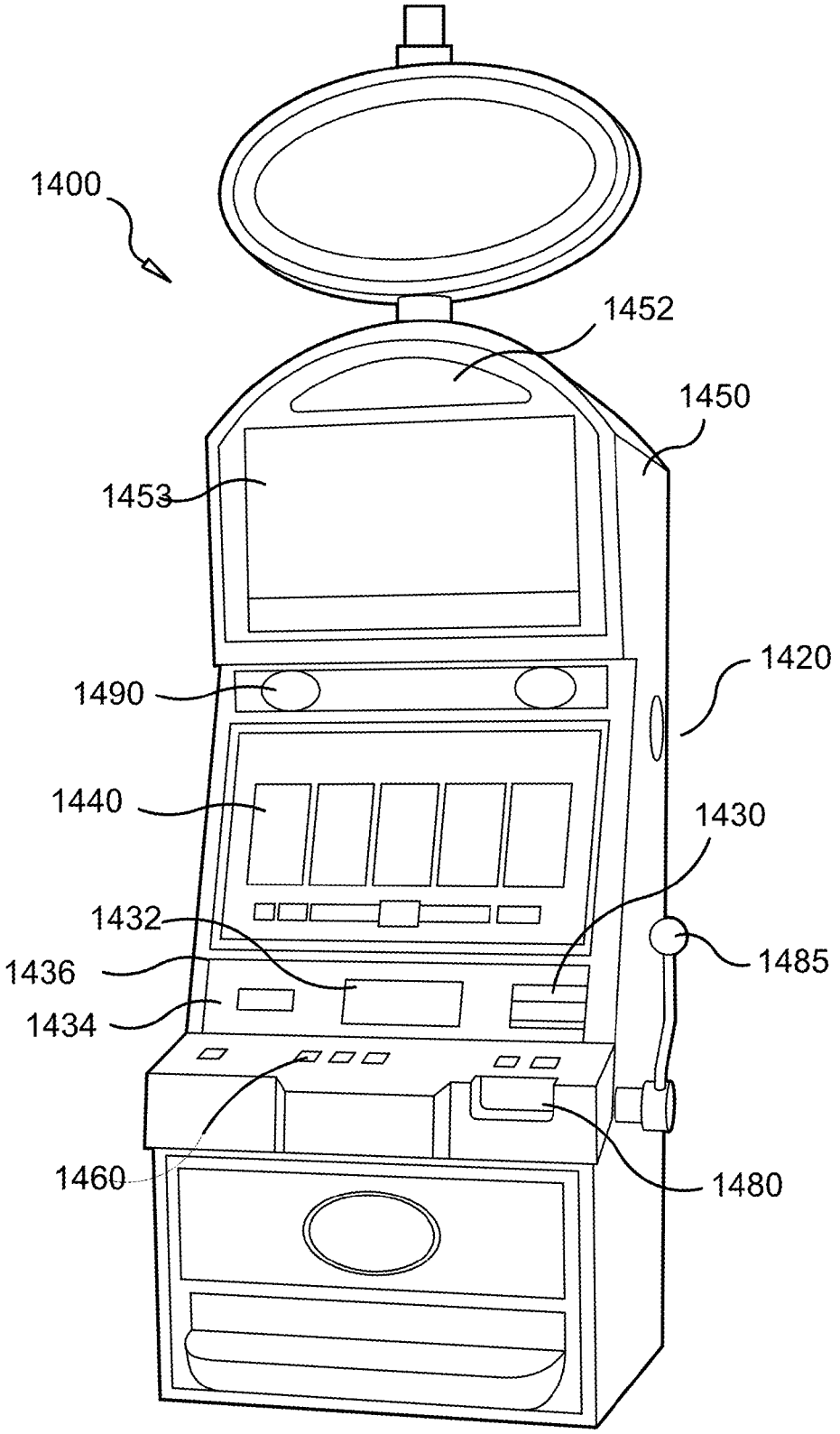
FIG. 14 is a perspective view of a gaming machine in accordance with one or more embodiments.

Referring to FIG. 14, gaming machine 1400 capable of supporting various embodiments of the invention is shown, including cabinet housing 1420, primary game display 1440 upon which a primary game and feature game may be displayed, top box 1450 which may display multiple progressives that may be won during play of the feature game, player-activated buttons 1460, player tracking panel 1436, bill/voucher acceptor 1480 and one or more speakers 1490. Cabinet housing 1420 may be a self-standing unit that is generally rectangular in shape and may be manufactured with reinforced steel or other rigid materials which are resistant to tampering and vandalism. Cabinet housing 1420 may alternatively be a handheld device including the gaming functionality as discussed herein and including various of the described components herein. For example, a handheld device may be a cell phone, personal data assistant, or laptop or tablet computer, each of which may include a display, a processor, and memory sufficient to support either stand-alone capability such as gaming machine 400 or thin client capability such as that incorporating some of the capability of a remote server.

In one or more embodiments, cabinet housing 1420 houses a processor, circuitry, and software (not shown) for receiving signals from the player-activated buttons 1460, operating the games, and transmitting signals to the respective displays and speakers. Any shaped cabinet may be implemented with any embodiment of gaming machine 1400 so long as it provides access to a player for playing a game. For example, cabinet 1420 may comprise a slant-top, bar-top, or table-top style cabinet, including a Bally Cinevision™ or CineReels™ cabinet. The operation of gaming machine 1400 is described more fully below.

The plurality of player-activated buttons 1460 may be used for various functions such as, but not limited to, selecting a wager denomination, selecting a game to be played, selecting a wager amount per game, initiating a game, or cashing out money from gaming machine 400. Buttons 460 may be operable as input mechanisms and may include mechanical buttons, electromechanical buttons or touch screen buttons. Optionally, a handle 1485 may be rotated by a player to initiate a game.

In one or more embodiments, buttons 1460 may be replaced with various other input mechanisms known in the art such as, but not limited to, a touch screen system, touch pad, track ball, mouse, switches, toggle switches, or other input means used to accept player input such as a Bally iDeck™. One other example input means is a universal button module as disclosed in U.S. application Ser. No. 11/106,212, entitled "Universal Button Module," filed on Apr. 14, 2005, which is hereby incorporated by reference. Generally, the universal button module provides a dynamic button system adaptable for use with various games and capable of adjusting to gaming systems having frequent game changes. More particularly, the universal button module may be used in connection with playing a game on a gaming machine and may be used for such functions as selecting the number of credits to bet per hand.

Cabinet housing 1420 may optionally include top box 1450 which contains "top glass" 1452 comprising advertising or payout information related to the game or games available on gaming machine 1400. Player tracking panel 1436 includes player tracking card reader 1434 and player tracking display 1432. Voucher printer 1430 may be integrated into player tracking panel 1436 or installed elsewhere in cabinet housing 1420 or top box 1450.

Game display 1440 may present a game of chance wherein a player receives one or more outcomes from a set of potential outcomes. For example, one such game of chance is a video slot machine game. In other aspects of the invention, gaming machine 1400 may present a video or mechanical reel slot machine, a video keno game, a lottery game, a bingo game, a Class II bingo game, a roulette game, a craps game, a blackjack game, a mechanical or video representation of a wheel game or the like.

Mechanical or video/mechanical embodiments may include game displays such as mechanical reels, wheels, or dice as required to present the game to the player. In video/mechanical or pure video embodiments, game display 1440 is, typically, a CRT or a flat-panel display in the form of, but not limited to, liquid crystal, plasma, electroluminescent, vacuum fluorescent, field emission, or any other type of panel display known or developed in the art. Game display 1440 may be mounted in either a "portrait" or "landscape" orientation and be of standard or "widescreen" dimensions (i.e., a ratio of one dimension to another of at least 16×9). For example, a widescreen display may be 32 inches wide by 18 inches tall. A widescreen display in a "portrait" orientation may be 32 inches tall by 18 inches wide. Additionally, game display 440 preferably includes a touch screen or touch glass system (not shown) and presents player interfaces such as, but not limited to, credit meter (not shown), win meter (not shown) and touch screen buttons (not shown). An example of a touch glass system is disclosed in U.S. Pat. No. 6,942,571, entitled "Gaming Device with Direction and Speed Control of Mechanical Reels Using Touch Screen," which is hereby incorporated by reference in its entirety for all purposes.

Game display 1440 may also present information such as, but not limited to, player information, advertisements and casino promotions, graphic displays, news and sports updates, or even offer an alternate game. This information may be generated through a host computer networked with gaming machine 1400 on its own initiative or it may be obtained by request of the player using either one or more of the plurality of player-activated buttons 1460; the game display itself, if game display 1440 comprises a touch screen or similar technology; buttons (not shown) mounted about game display 1440 which may permit selections such as those found on an ATM machine, where legends on the screen are associated with respective selecting buttons; or any player input device that offers the required functionality.

Cabinet housing 1420 incorporates a single game display 1440. However, in alternate embodiments, cabinet housing 1420 or top box 1450 may house one or more additional displays 1453 or components used for various purposes including additional game play screens, animated "top glass," progressive meters or mechanical or electromechanical devices (not shown) such as, but not limited to, wheels, pointers or reels. The additional displays may or may not include a touch screen or touch glass system.

Figure 15A:
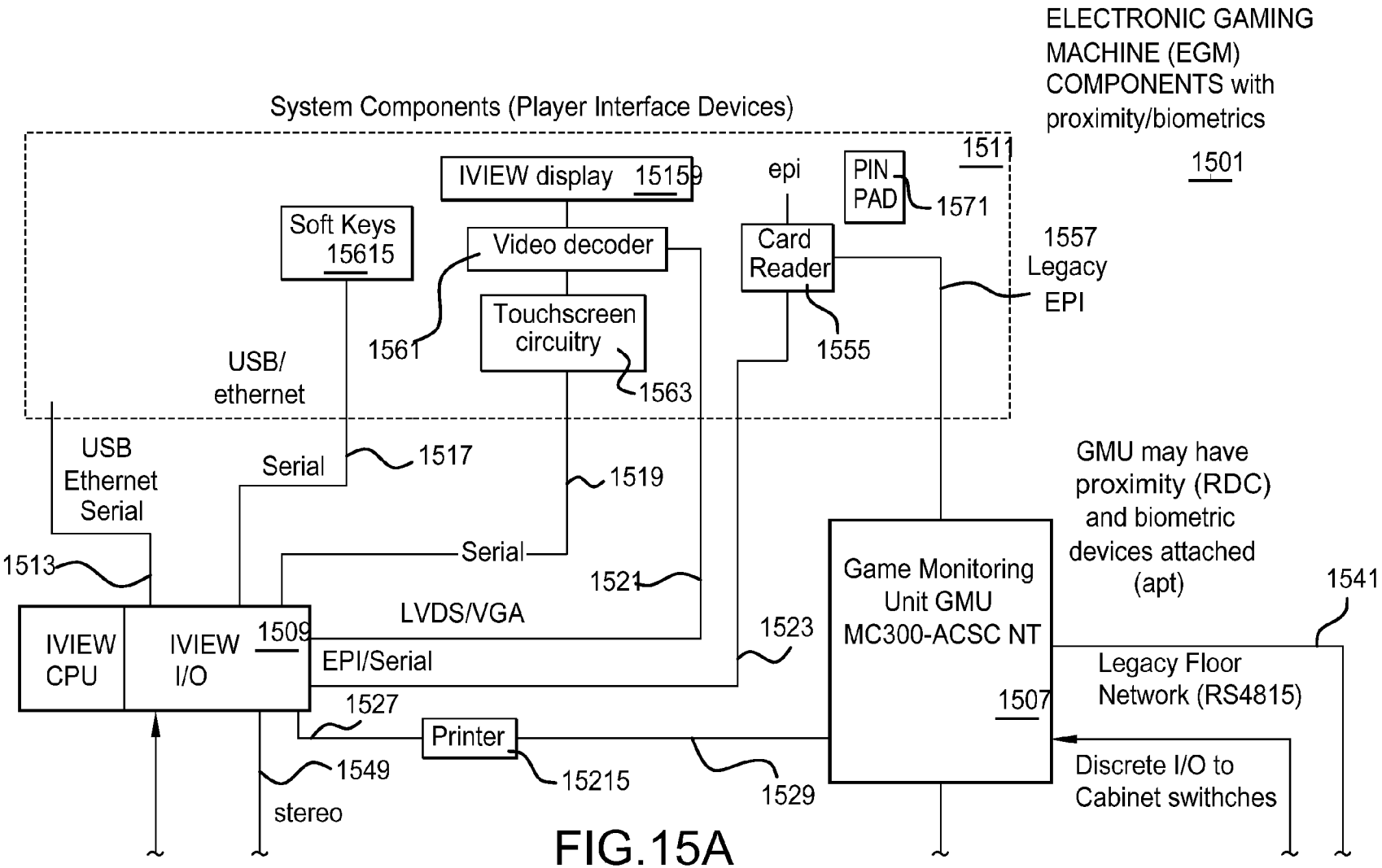
FIG. 15A in combination with FIG. 15B is a block diagram of the physical and logical components of the gaming machine of FIG. 14 in accordance with one or more embodiments.
Figure 15B:
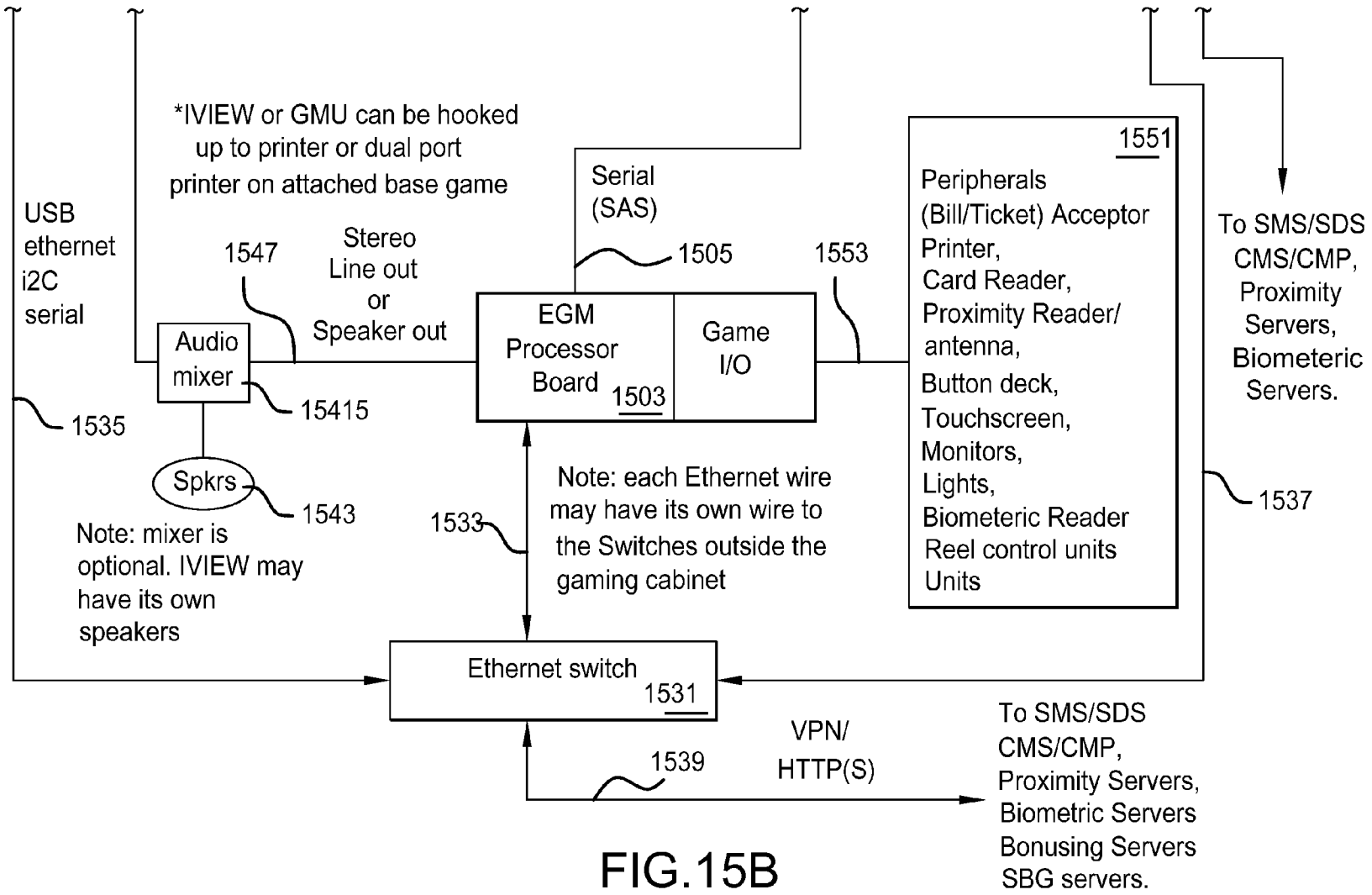

Referring to FIGS. 15A and 15B, electronic gaming machine 1501 is shown in accordance with one or more embodiments. Electronic gaming machine 1501 includes base game integrated circuit board 1503 (EGM Processor Board) connected through serial bus line 1505 to game monitoring unit (GMU) 1507 (such as a Bally MC300 or ACSC NT), and player interface integrated circuit board (PIB) 1509 connected to player interface devices 1511 over bus lines 1513, 1515, 1517, 1519, 1521, 1523. Printer 1525 is connected to PIB 1509 and GMU 1507 over bus lines 1527, 1529. Base game integrated circuit board 1503, PIB 1509, and GMU 1507 connect to Ethernet switch 1531 over bus lines 1533, 1535, 1537. Ethernet switch 1531 connects to a slot management system (SMS) and a casino management system (CMS) network over bus line 1539. GMU 1507 also may connect to the SMS and CMS network over bus line 1541. Speakers 1543 connect through audio mixer 1545 and bus lines 1547, 1549 to base game integrated circuit board 1503 and PIB 1509. The proximity and biometric devices and circuitry may be installed by upgrading a commercially available PIB 1509, such as a Bally iView unit. Coding executed on base game integrated circuit board 1503, PIB 1509, and/or GMU 1507 may be upgraded to integrate a game having adjustable multi-part indicia as is more fully described herein.

Peripherals 1551 connect through i/o board 1553 to base game integrated circuit board 1503. For example, a bill/ticket acceptor is typically connected to a game input-output board 1553 which is, in turn, connected to a conventional central processing unit ("CPU") base game integrated circuit board 1503, such as an Intel Pentium microprocessor mounted on a gaming motherboard. I/O board 1553 may be connected to base game integrated circuit board 1503 by a serial connection such as RS-232 or USB or may be attached to the processor by a bus such as, but not limited to, an ISA bus. The gaming motherboard may be mounted with other conventional components, such as are found on conventional personal computer motherboards, and loaded with a game program which may include a gaming machine operating system (OS), such as a Bally Alpha OS. Base game integrated circuit board 1503 executes a game program that causes base game integrated circuit board 1503 to play a game. In one embodiment, the game program provides a slot machine game having adjustable multi-part indicia. The various components and included devices may be installed with conventionally and/or commercially available components, devices, and circuitry into a conventional and/or commercially available gaming machine cabinet, examples of which are described above.

When a player has inserted a form of currency such as, for example and without limitation, paper currency, coins or tokens, cashless tickets or vouchers, electronic funds transfers or the like into the currency acceptor, a signal is sent by way of I/O board 1553 to base game integrated circuit board 1503 which, in turn, assigns an appropriate number of credits for play in accordance with the game program. The player may further control the operation of the gaming machine by way of other peripherals 1551, for example, to select the amount to wager via electromechanical or touch screen buttons. The game starts in response to the player operating a start mechanism such as a handle or touch screen icon. The game program includes a random number generator to provide a display of randomly selected indicia on one or more displays. In some embodiments, the random generator may be physically separate from gaming machine 1500; for example, it may be part of a central determination host system which provides random game outcomes to the game program. Thereafter, the player may or may not interact with the game through electromechanical or touch screen buttons to change the displayed indicia. Finally, base game integrated circuit board 1503 under control of the game program and OS compares the final display of indicia to a pay table. The set of possible game outcomes may include a subset of outcomes related to the triggering of a feature game. In the event the displayed outcome is a member of this subset, base game integrated circuit board 1503, under control of the game program and by way of I/O Board 1553, may cause feature game play to be presented on a feature display.

Predetermined payout amounts for certain outcomes, including feature game outcomes, are stored as part of the game program. Such payout amounts are, in response to instructions from base game integrated circuit board 1503, provided to the player in the form of coins, credits or currency via I/O board 1553 and a pay mechanism, which may be one or more of a credit meter, a coin hopper, a voucher printer, an electronic funds transfer protocol or any other payout means known or developed in the art.

In various embodiments, the game program is stored in a memory device (not shown) connected to or mounted on the gaming motherboard. By way of example, but not by limitation, such memory devices include external memory devices, hard drives, CD-ROMs, DVDs, and flash memory cards. In an alternative embodiment, the game programs are stored in a remote storage device. In one embodiment, the remote storage device is housed in a remote server. The gaming machine may access the remote storage device via a network connection, including but not limited to, a local area network connection, a TCP/IP connection, a wireless connection, or any other means for operatively networking components together. Optionally, other data including graphics, sound files and other media data for use with the EGM are stored in the same or a separate memory device (not shown). Some or all of the game program and its associated data may be loaded from one memory device into another, for example, from flash memory to random access memory (RAM).

In one or more embodiments, peripherals may be connected to the system over Ethernet connections directly to the appropriate server or tied to the system controller inside the EGM using USB, serial or Ethernet connections. Each of the respective devices may have upgrades to their firmware utilizing these connections.

GMU 1507 includes an integrated circuit board and GMU processor and memory including coding for network communications, such as the G2S (game-to-system) protocol from the Gaming Standards Association, Las Vegas, Nev., used for system communications over the network. As shown, GMU 1507 may connect to card reader 1555 through bus 1557 and may thereby obtain player card information and transmit the information over the network through bus 1541. Gaming activity information may be transferred by the base game integrated circuit board 1503 to GMU 1507 where the information may be translated into a network protocol, such as S2S, for transmission to a server, such as a player tracking server, where information about a player's playing activity may be stored in a designated server database.

PIB 1509 includes an integrated circuit board, PID processor, and memory which includes an operating system, such as Windows CE, a player interface program which may be executable by the PID processor together with various input/output (I/O) drivers for respective devices which connect to PIB 1509, such as player interface devices 511, and which may further include various games or game components playable on PIB 1509 or playable on a connected network server and PIB 1509 is operable as the player interface. PIB 1509 connects to card reader 1555 through bus 1523, display 1559 through video decoder 1561 and bus 1521, such as an LVDS or VGA bus.

As part of its programming, the PID processor executes coding to drive display 1559 and provide messages and information to a player. Touch screen circuitry interactively connects display 1559 and video decoder 1561 to PIB 1509, such that a player may input information and cause the information to be transmitted to PIB 1509 either on the player's initiative or responsive to a query by PIB 1509. Additionally soft keys 1565 connect through bus 1517 to PIB 1509 and operate together with display 1559 to provide information or queries to a player and receive responses or queries from the player. PIB 1509, in turn, communicates over the CMS/SMS network through Ethernet switch 1531 and busses 1535, 1539 and with respective servers, such as a player tracking server.

Player interface devices 1511 are linked into the virtual private network of the system components in gaming machine 1501. The system components include the iView processing board and game monitoring unit (GMU) processing board. These system components may connect over a network to the slot management system (such as a commercially available Bally SDS/SMS) and/or casino management system (such as a commercially available Bally CMP/CMS).

The GMU system component has a connection to the base game through a serial SAS connection and is connected to various servers using, for example, HTTPs over Ethernet. Through this connection, firmware, media, operating system software, gaming machine configurations can be downloaded to the system components from the servers. This data is authenticated prior to install on the system components.

The system components include the iView processing board and game monitoring unit (GMU) processing board. The GMU and iView can combined into one like the commercially available Bally GTM iView device. This device may have a video mixing technology to mix the EGM processor's video signals with the iView display onto the top box monitor or any monitor on the gaming device.

Figure 16:
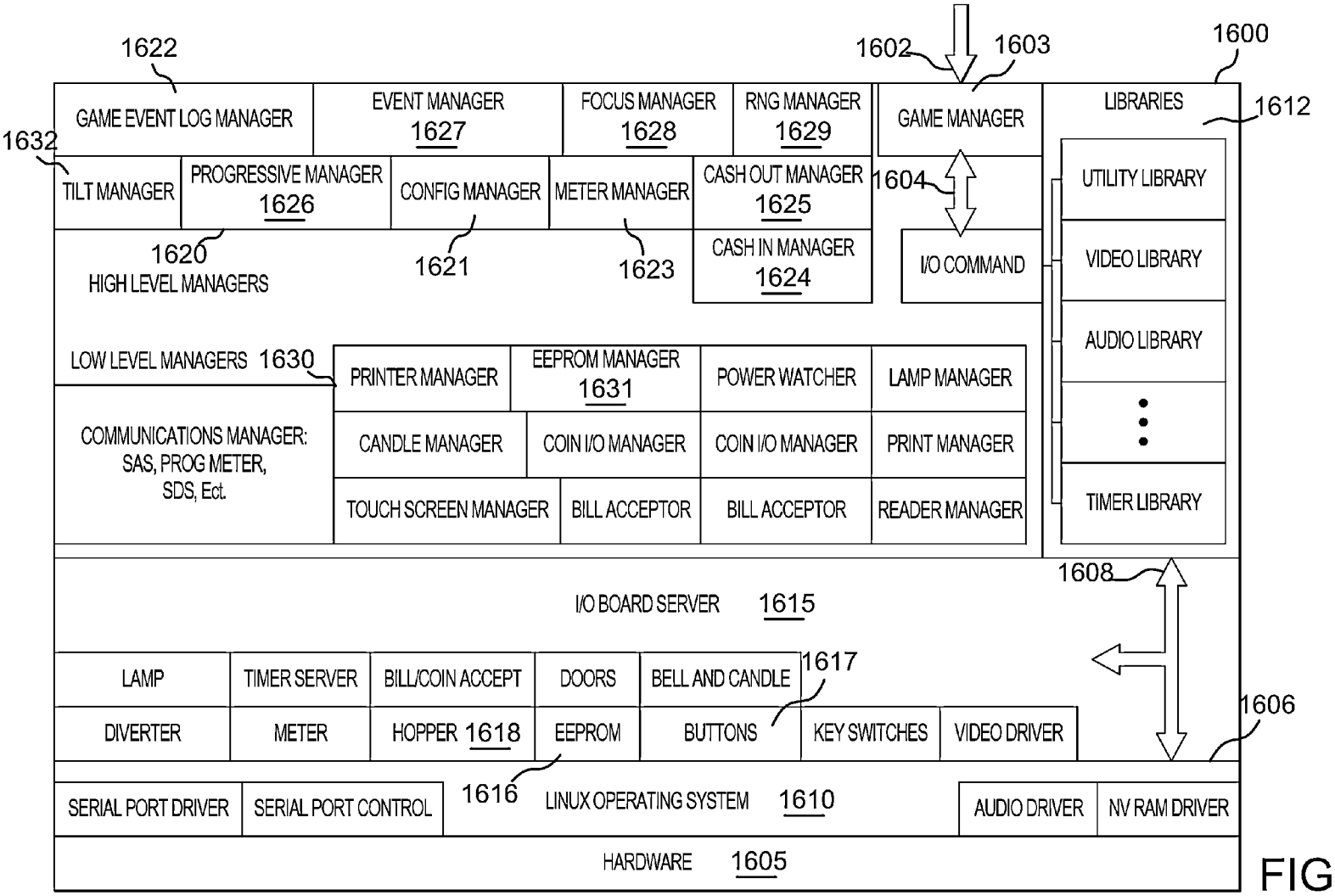
FIG. 16 is a block diagram of the logical components of a gaming kernel in accordance with one or more embodiments.

In accordance with one or more embodiments, FIG. 16 is a functional block diagram of a gaming kernel 1600 of a game program under control of base game integrated circuit board 1503. The game program uses gaming kernel 1600 by calling into application programming interface (API) 1602, which is part of game manager 1603. The components of game kernel 1600 as shown in FIG. 16 are only illustrative, and should not be considered limiting. For example, the number of managers may be changed, additional managers may be added or some managers may be removed without deviating from the scope and spirit of the invention.

As shown in the example, there are three layers: a hardware layer 1605; an operating system layer 1610, such as, but not limited to, Linux; and a game kernel layer 1600 having game manager 1603 therein. In one or more embodiments, the use of a standard operating system 1610, such a UNIX-based or Windows-based operating system, allows game developers interfacing to the gaming kernel to use any of a number of standard development tools and environments available for the operating systems. This is in contrast to the use of proprietary, low level interfaces which may require significant time and engineering investments for each game upgrade, hardware upgrade, or feature upgrade. The game kernel layer 1600 executes at the user level of the operating system 1610, and itself contains a major component called the I/O Board Server 1615. To properly set the bounds of game application software (making integrity checking easier), all game applications interact with gaming kernel 1600 using a single API 1602 in game manager 1603. This enables game applications to make use of a well-defined, consistent interface, as well as making access points to gaming kernel 1600 controlled, where overall access is controlled using separate processes.

For example, game manager 1603 parses an incoming command stream and, when a command dealing with I/O comes in (arrow 1604), the command is sent to an applicable library routine 1612. Library routine 1612 decides what it needs from a device, and sends commands to I/O Board Server 1615 (see arrow 1608). A few specific drivers remain in operating system 1610's kernel, shown as those below line 1606. These are built-in, primitive, or privileged drivers that are (i) general (ii) kept to a minimum and (iii) are easier to leave than extract. In such cases, the low-level communications is handled within operating system 1610 and the contents passed to library routines 1612.

Thus, in a few cases library routines may interact with drivers inside operating system 1610, which is why arrow 1608 is shown as having three directions (between library utilities 1612 and I/O Board Server 1615, or between library utilities 1612 and certain drivers in operating system 1610). No matter which path is taken, the logic needed to work with each device is coded into modules in the user layer of the diagram. Operating system 1610 is kept as simple, stripped down, and common across as many hardware platforms as possible. The library utilities and user-level drivers change as dictated by the game cabinet or game machine in which it will run. Thus, each game cabinet or game machine may have an base game integrated circuit board 1503 connected to a unique, relatively dumb, and as inexpensive as possible I/O adapter board 1540, plus a gaming kernel 1600 which will have the game-machine-unique library routines and I/O Board Server 1615 components needed to enable game applications to interact with the gaming machine cabinet. Note that these differences are invisible to the game application software with the exception of certain functional differences (i.e., if a gaming cabinet has stereo sound, the game application will be able make use of API 1602 to use the capability over that of a cabinet having traditional monaural sound).

Game manager 1603 provides an interface into game kernel 1600, providing consistent, predictable, and backwards compatible calling methods, syntax, and capabilities by way of game application API 1602. This enables the game developer to be free of dealing directly with the hardware, including the freedom to not have to deal with low-level drivers as well as the freedom to not have to program lower level managers 1630, although lower level managers 630 may be accessible through game manager 1603's interface 1602 if a programmer has the need. In addition to the freedom derived from not having to deal with the hardware level drivers and the freedom of having consistent, callable, object-oriented interfaces to software managers of those components (drivers), game manager 1603 provides access to a set of upper level managers 1620 also having the advantages of consistent callable, object-oriented interfaces, and further providing the types and kinds of base functionality required in casino-type games. Game manager 1603, providing all the advantages of its consistent and richly functional interface 1602 as supported by the rest of game kernel 1600, thus provides a game developer with a multitude of advantages.

Game manager 1603 may have several objects within itself, including an initialization object (not shown). The initialization object performs the initialization of the entire game machine, including other objects, after game manager 1603 has started its internal objects and servers in appropriate order. In order to carry out this function, the kernel's configuration manager 1621 is among the first objects to be started; configuration manager 1621 has data needed to initialize and correctly configure other objects or servers.

The upper level managers 1620 of game kernel 1600 may include game event log manager 1622 which provides, at the least, a logging or logger base class, enabling other logging objects to be derived from this base object. The logger object is a generic logger; that is, it is not aware of the contents of logged messages and events. The log manager's (1622) job is to log events in non-volatile event log space. The size of the space may be fixed, although the size of the logged event is typically not. When the event space or log space fills up, one embodiment will delete the oldest logged event (each logged event will have a time/date stamp, as well as other needed information such as length), providing space to record the new event. In this embodiment, the most recent events will thus be found in the log space, regardless of their relative importance. Further provided is the capability to read the stored logs for event review.

In accordance with one embodiment, meter manager 1623 manages the various meters embodied in the game kernel 1600. This includes the accounting information for the game machine and game play. There are hard meters (counters) and soft meters; the soft meters may be stored in non-volatile storage such as non-volatile battery-backed RAM to prevent loss. Further, a backup copy of the soft meters may be stored in a separate non-volatile storage such as EEPROM. In one embodiment, meter manager 1623 receives its initialization data for the meters, during start-up, from configuration manager 1621. While running, the cash in (1624) and cash out (1625) managers call the meter manager's (1623) update functions to update the meters. Meter manager 1623 will, on occasion, create backup copies of the soft meters by storing the soft meters' readings in EEPROM. This is accomplished by calling and using EEPROM manager 1631.

In accordance with still other embodiments, progressive manager 1626 manages progressive games playable from the game machine. Event manager 1627 is generic, like log manager 1622, and is used to manage various gaming machine events. Focus manager 628 correlates which process has control of various focus items. Tilt manager 1632 is an object that receives a list of errors (if any) from configuration manager 1621 at initialization, and during game play from processes, managers, drivers, etc. that may generate errors. Random number generator manager 1629 is provided to allow easy programming access to a random number generator (RNG), as a RNG is required in virtually all casino-style (gambling) games. RNG manager 1629 includes the capability of using multiple seeds.

In accordance with one or more embodiments, a credit manager object (not shown) manages the current state of credits (cash value or cash equivalent) in the game machine, including any available winnings, and further provides denomination conversion services. Cash out manager 1625 has the responsibility of configuring and managing monetary output devices. During initialization, cash out manager 1625, using data from configuration manager 1621, sets the cash out devices correctly and selects any selectable cash out denominations. During play, a game application may post a cash out event through the event manager 1627 (the same way all events are handled), and using a call-back posted by cash out manager 1625, cash out manager 1625 is informed of the event. Cash out manager 1625 updates the credit object, updates its state in non-volatile memory, and sends an appropriate control message to the device manager that corresponds to the dispensing device. As the device dispenses dispensable media, there will typically be event messages being sent back and forth between the device and cash out manager 1625 until the dispensing finishes, after which cash out manager 1625, having updated the credit manager and any other game state (such as some associated with meter manager 1623) that needs to be updated for this set of actions, sends a cash out completion event to event manager 1627 and to the game application thereby. Cash in manager 624 functions similarly to cash out manager 1625, only controlling, interfacing with, and taking care of actions associated with cashing in events, cash in devices, and associated meters and crediting.

In a further example, in accordance with one or more embodiments, I/O server 1615 may write data to the gaming machine EEPROM memory, which is located in the gaming machine cabinet and holds meter storage that must be kept even in the event of power failure. Game manager 1603 calls the I/O library functions to write data to the EEPROM. The I/O server 1615 receives the request and starts a low priority EEPROM thread 1616 within I/O server 1615 to write the data. This thread uses a sequence of 8 bit command and data writes to the EEPROM device to write the appropriate data in the proper location within the device. Any errors detected will be sent as IPC messages to game manager 1603. All of this processing is asynchronous.

In accordance with one embodiment, button module 1617 within I/O server 1615, polls (or is sent) the state of buttons every 2 ms. These inputs are debounced by keeping a history of input samples. Certain sequences of samples are required to detect a button was pressed, in which case the I/O server 1615 sends an inter-process communication event to game manager 1603 that a button was pressed or released. In some embodiments, the gaming machine may have intelligent distributed I/O which debounces the buttons, in which case button module 1617 may be able to communicate with the remote intelligent button processor to get the button events and simply relay them to game manager 1603 via IPC messages. In still another embodiment, the I/O library may be used for pay out requests from the game application. For example, hopper module 1618 must start the hopper motor, constantly monitor the coin sensing lines of the hopper, debounce them, and send an IPC message to the game manager 1603 when each coin is paid.

Further details, including disclosure of lower level fault handling and/or processing, are included in U.S. Pat. No. 7,351,151 entitled "Gaming Board Set and Gaming Kernel for Game Cabinets" and provisional U.S. patent application No. 60/313,743, entitled "Form Fitting Upgrade Board Set For Existing Game Cabinets," filed Aug. 20, 2001; said patent and provisional are both fully incorporated herein by explicit reference.

Figure 17A:
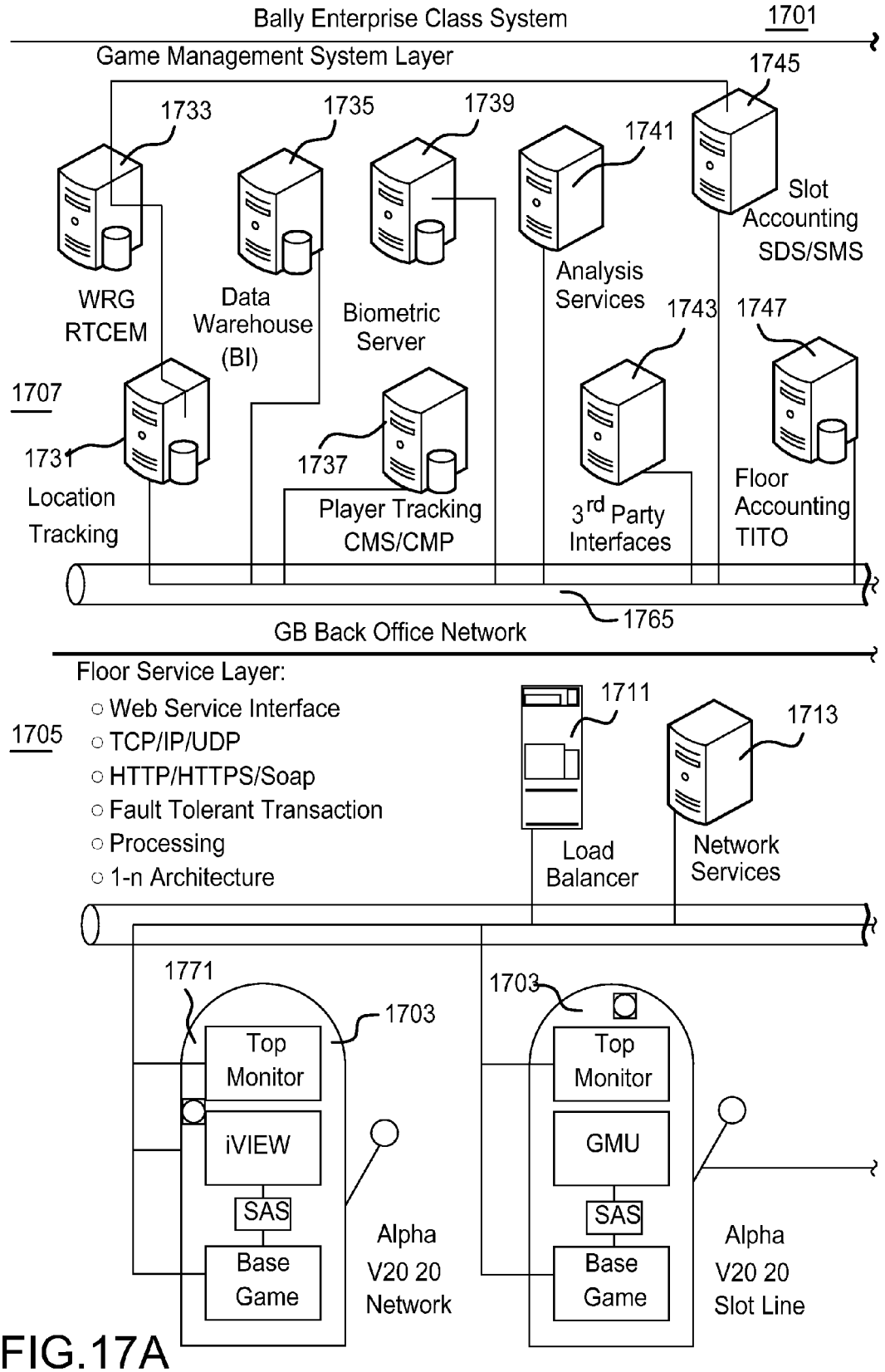
FIG. 17A in combination with FIG. 17B is a schematic block diagram showing the hardware elements of a networked gaming system in accordance with one or more embodiments.
Figure 17B:
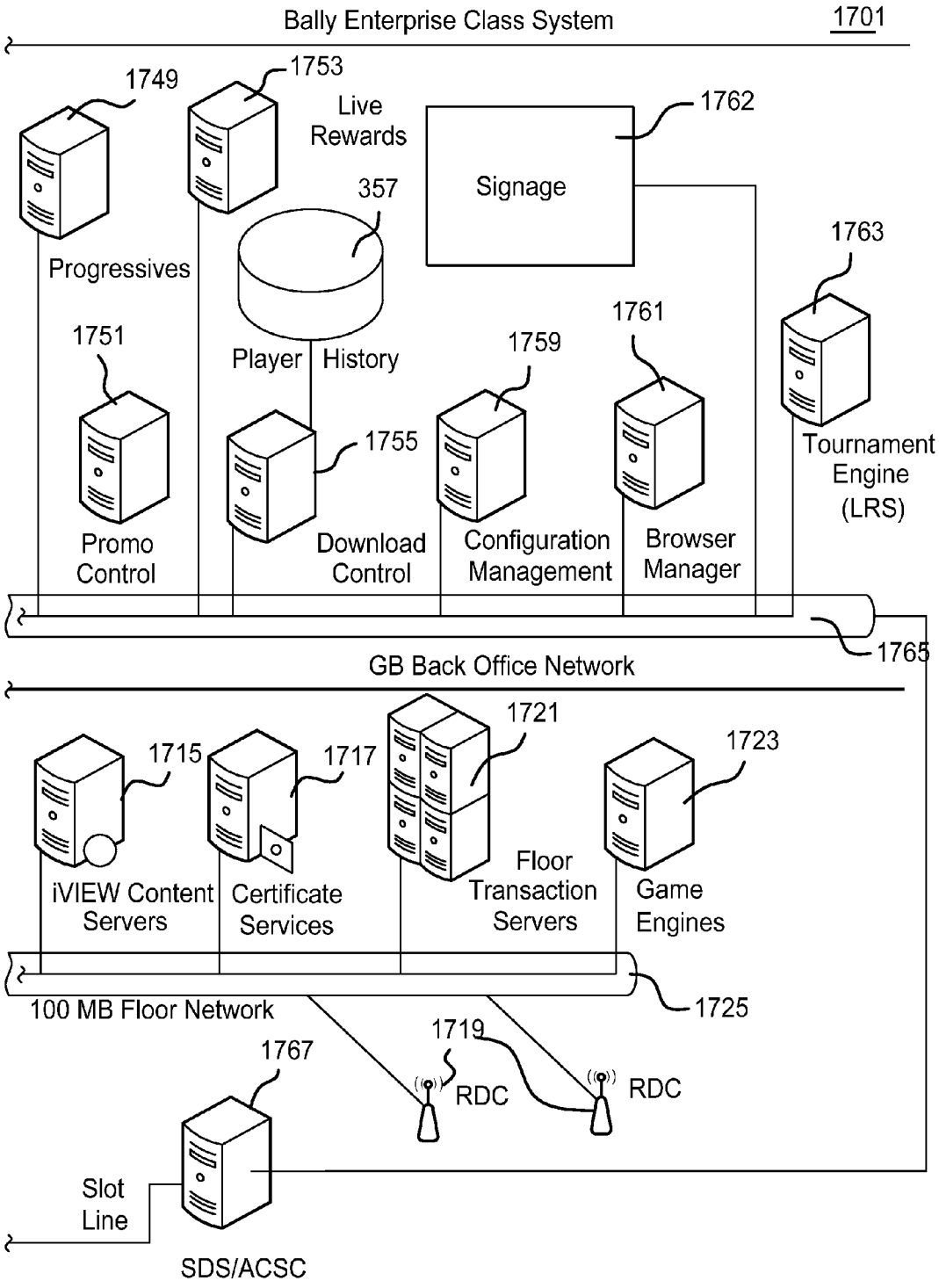

Referring to FIGS. 17A and 17B, enterprise gaming system 1701 is shown in accordance with one or more embodiments. Enterprise gaming system 1701 may include one casino or multiple locations and generally includes a network of gaming machines 1703, floor management system (SMS) 1705, and casino management system (CMS) 1707. SMS 1705 may include load balancer 1711, network services servers 1713, player interface (iView) content servers 1715, certificate services server 1717, floor radio dispatch receiver/transmitters (RDC) 1719, floor transaction servers 1721 and game engines 1723, each of which may connect over network bus 1725 to gaming machines 1703. CMS 1707 may include location tracking server 1731, WRG RTCEM server 1733, data warehouse server 1735, player tracking server 1737, biometric server 1739, analysis services server 1741, third party interface server 1743, slot accounting server 1745, floor accounting server 1747, progressives server 1749, promo control server 1751, feature game (such as Bally Live Rewards) server 1753, download control server 1755, player history database 1757, configuration management server 1759, browser manager 1761, tournament engine server 1763 connecting through bus 1765 to server host 1767 and gaming machines 1703. The various servers and gaming machines 1703 may connect to the network with various conventional network connections (such as, for example, USB, serial, parallel, RS485, Ethernet). Additional servers which may be incorporated with CMS 1707 include a responsible gaming limit server (not shown), advertisement server (not shown), and a control station server (not shown) where an operator or authorized personnel may select options and input new programming to adjust each of the respective servers and gaming machines 1703. SMS 1705 may also have additional servers including a control station (not shown) through which authorized personnel may select options, modify programming, and obtain reports of the connected servers and devices, and obtain reports. The various CMS and SMS servers are descriptively entitled to reflect the functional executable programming stored thereon and the nature of databases maintained and utilized in performing their respective functions.

Gaming machines 1703 include various peripheral components that may be connected with USB, serial, parallel, RS-485 or Ethernet devices/architectures to the system components within the respective gaming machine. The GMU has a connection to the base game through a serial SAS connection. The system components in the gaming cabinet may be connected to the servers using HTTPs or G2S over Ethernet. Using CMS 1707 and/or SMS 1705 servers and devices, firmware, media, operating systems, and configurations may be downloaded to the system components of respective gaming machines for upgrading or managing floor content and offerings in accordance with operator selections or automatically depending upon CMS 1707 and SMS 1705 master programming. The data and programming updates to gaming machines 1703 are authenticated using conventional techniques prior to install on the system components.

In various embodiments, any of the gaming machines 1703 may be a mechanical reel spinning slot machine or a video slot machine or a gaming machine offering one or more of the above described games including a group play game. Alternately, gaming machines 1703 may provide a game with a simulated musical instrument interface as a primary or base game or as one of a set of multiple primary games selected for play by a random number generator. A gaming system of the type described above also allows a plurality of games in accordance with the various embodiments of the invention to be linked under the control of a group game server (not shown) for cooperative or competitive play in a particular area, carousel, casino or between casinos located in geographically separate areas. For example, one or more examples of group games under control of a group game server are disclosed in U.S. application Ser. No. 11/938,079, entitled "Networked System and Method for Group Play Gaming," filed on Nov. 9, 2007, which is hereby incorporated by reference in its entirety for all purposes.

Figure 18:
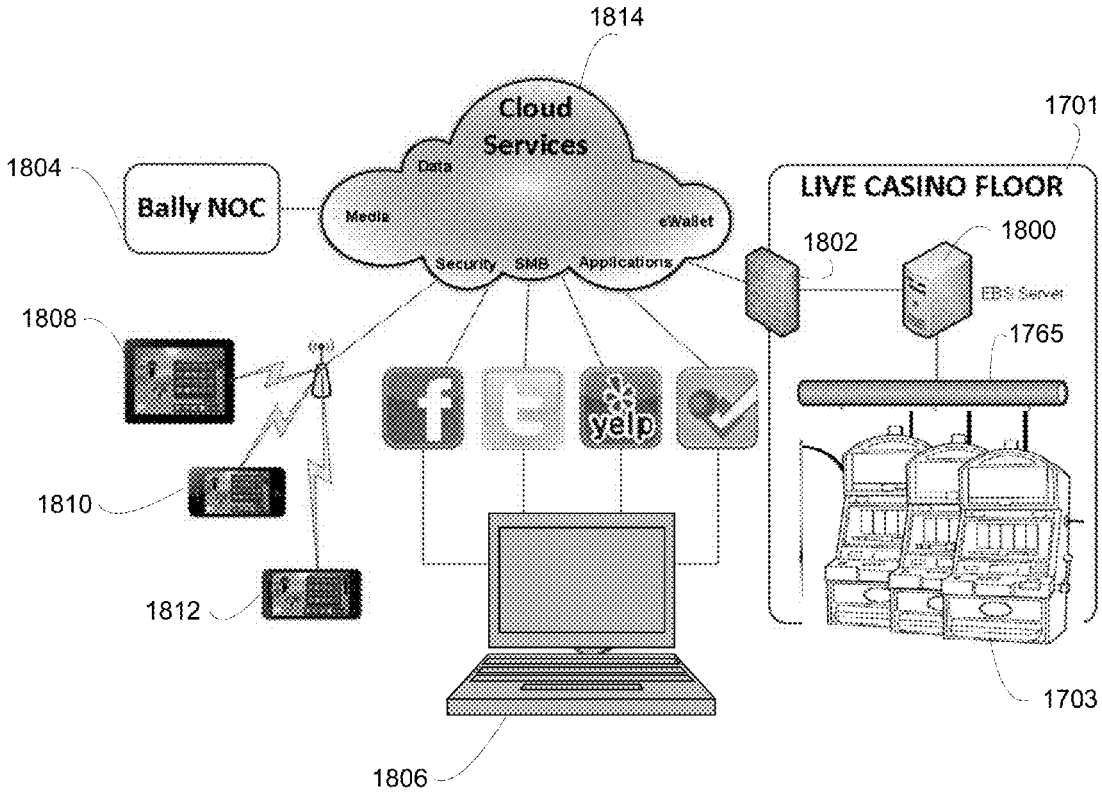
FIG. 18 is a diagram showing an example of an architecture for tying a casino enterprise network to an external provider of games and content to Internet or broadband communication capable devices.

All or portions of the present invention may also be implemented or promoted by or through a system as suggested in FIG. 18. At 1701 is the gaming system of FIG. 17, which may be hosted at a casino property enterprise, across several casino enterprises or by a third party host. As described above, the gaming system 1701 has a network communication bus 1765 providing for communication between the gaming terminals 1703 and various servers. To provide the functionality illustrated in FIG. 18, a bonusing server 1800, such as a Bally Elite Bonusing Server is connected to the network communication bus 1765 (FIG. 17) for communication to the gaming system 1701, the gaming terminals 1703 and the various servers and other devices as described above. Through a secure network firewall 1802 the bonusing server 1800 is in communication with a cloud computing/storage service 1804 which may be hosted by the casino enterprise, a licensed third party or if permitted by gaming regulators an unlicensed provider. For example the cloud service 1804 may be as provided by Microsoft® Private Cloud Solutions offered by Microsoft Corp. of Redmond, Wash., USA. The cloud service 1804 provides various applications which can be accessed and delivered to, for example, personal computers 1806, portable computing devices such as computer tablets 1808, personal digital assistants (PDAs) 1810 and cellular devices 1812 such as telephones and smart phones. As but an example, the cloud service 1804 may store and host an eWallet application, casino or player-centric applications such as downloadable or accessible applications including games, promotional material or applications directed to and/or affecting a casino customers interaction with a casino enterprise (such as accessing the players casino account, establishing casino credit or the like), providing bonuses to players through system wide bonusing (SMB) or specific bonusing or comps to players, or other applications. The cloud service 1804 includes security provide for secure communication with the cloud service 1804 between the player/users and the cloud service 1804 and between the cloud service 1804 and the gaming system 1701. Security applications may be through encryption, the use of personal identification numbers (PINS) or other devices and systems. As suggested in FIG. 5 the cloud service 1004 stores player/user data retrieved from players/users and from the gaming system 1701.

The players/users may access the cloud service 1804 and the applications and data provided thereby through the Internet or through broadband wireless cellular communication systems and any intervening sort range wireless communication such as WiFi. The players/users may access the applications and data through various social media offerings such as Facebook, Twitter, Yelp, MySpace, LinkedIn or the like.

As but an example, a player/user may have a player account with a casino enterprise Z. That account may include data such as the player's credit level, their rating and their available comps. The account may further track any certificates, and the present value thereof, the player may have won as a result of the playing a game according to the present invention. At their smart phone 1812 the player/user sends a request to the clout service 1804 (perhaps through a previously downloaded application) to request the status of their available comps such as how many comp points they have and what may be available through redemption of those points (e.g. lodging, cash back, meals or merchandise). The application for the request may present casino promotions, graphics or other advertising to the player/user. The application, to support such a request, would typically require the player/user to enter a PIN. The cloud service 1004 forwards the inquiry to the bonusing servicer 1800 which, in turn, confirms the PIN and retrieves the requested information from the data warehouse 1735 (FIG. 17) or player tracking CMS/CMP server 1737 (FIG. 17). Alternatively the data may be stored in the cloud service 1804 and routinely updated from the data warehouse 1735 or player tracking CMS/CMP server 1737. In this instance the request would be responded to from data residing with the cloud service 1804. The information is formatted by the cloud server 1804 application and delivered to the player/user. The delivery may be formatted based upon the player/user's device operating system (OS), display size or the like.

The cloud service 1800 may also host game applications to provide virtual instances of games for free, promotional, or where permitted, P2P (Pay to Play) supported gaming. Third party developers may also have access to placing applications with the cloud service 1804 through, for example a national operations center (Bally NOC 1814). A game software manufacturer such as Bally Gaming, Inc. may also provide game applications on its own or on behalf of the casino enterprise.

Other media such as advertising, notices (such as an upcoming tournament) may also be provided to the cloud service 1804. When a player/user accesses the cloud service 1804 certain media may be delivered to the player/user in a manner formatted for their application and device.

Although the description above contains many specificities, these should not be construed as limiting the scope of the invention but as merely providing an illustration of the presently preferred embodiment of the invention. Thus the scope of this invention should be determined by the appended claims and their legal equivalents.

What is claimed is:

1. A progressive system for paying out a primary progressive prize and one or more secondary prizes, said progressive system comprising:

a progressive controller;

a plurality of game devices, each comprising a first input device to detect a physical item associated with a monetary value to establish a credit balance and a second input device to receives a cashout input that initiates a payout from the credit balance configured to receive one or more wagers that are deducted from the credit balance and to execute a game of chance and, upon a win event, award one or more certificates redeemable for one or more shares of a certificate pool upon occurrence of a progressive win event;

a network interconnecting said progressive controller and said plurality of game devices;

a funding module executable by said progressive controller, said funding module configured to:

allocate a fixed percentage of the one or more wagers to funding a progressive award pool and a certificate award pool;

apply a first portion of the fixed percentage to the progressive pool and a second portion of the fixed percentage to a certificate pool;

determine the current value of a share of the certificate pool based at least in part on the number of shares awarded to date and the current value of the certificate pool;

make the current value per share known to players or perspective players of the game devices;

upon occurrence of the progressive win event, fix the redemption value of the awarded certificates according to the current value of a share of the certificate pool.

2. The system of claim 1 wherein the first portion of the fixed percentage decreases over time and the second portion of the fixed percentage correspondingly increases over time.

3. The system of claim 1, wherein some or all of a mystery award pool is paid upon occurrence of the mystery win event.

4. The system of claim 3 further comprising a third portion of the fixed percentage of the progressive pool allocated to funding the mystery award pool.

5. The system of claim 4, wherein the first and third portions of the fixed percentage decrease over time and the second portion of the fixed percentage correspondingly increases over time.

* * * * *